US007848697B2

(12) United States Patent
Honda et al.

(10) Patent No.: US 7,848,697 B2
(45) Date of Patent: Dec. 7, 2010

(54) SHEET PROCESSING APPARATUS AND IMAGE FORMING APPARATUS

(75) Inventors: Kazuhiro Honda, Kashiwa (JP); Masahiro Yonenuma, Matsudo (JP)

(73) Assignee: Canon Finetech Inc., Misato-shi (JP)

( * ) Notice: Subject to any disclaimer, the term of this patent is extended or adjusted under 35 U.S.C. 154(b) by 865 days.

(21) Appl. No.: 11/690,491

(22) Filed: Mar. 23, 2007

(65) Prior Publication Data

US 2007/0231035 A1 Oct. 4, 2007

(30) Foreign Application Priority Data

Mar. 31, 2006 (JP) ..... 2006-100933

(51) Int. Cl.
*G03G 15/00* (2006.01)
*B65H 29/00* (2006.01)

(52) U.S. Cl. ..... 399/407; 399/397; 399/381

(58) Field of Classification Search ..... 399/361, 399/363, 381, 388, 397, 402–410; *G03G 15/00; B65H 29/00*

See application file for complete search history.

(56) References Cited

U.S. PATENT DOCUMENTS

| | | | | |
|---|---|---|---|---|
| 5,653,439 | A * | 8/1997 | Rider et al. | 271/274 |
| 5,819,149 | A * | 10/1998 | Watanabe et al. | 399/330 |
| 6,268,909 | B1 * | 7/2001 | Honmochi et al. | 355/407 |
| 7,165,764 | B2 | 1/2007 | Nakamura et al. | 270/58.11 |
| 2004/0175217 | A1 * | 9/2004 | Nakamura et al. | 399/407 |
| 2004/0178572 | A1 | 9/2004 | Nishimura et al. | |
| 2005/0067748 | A1 | 3/2005 | Fujii et al. | |
| 2005/0129442 | A1 * | 6/2005 | Matsumoto et al. | 399/405 |
| 2005/0184443 | A1 * | 8/2005 | Satoh et al. | 271/10.01 |
| 2007/0057434 | A1 | 3/2007 | Nakamura et al. | 271/109 |

FOREIGN PATENT DOCUMENTS

| | | |
|---|---|---|
| JP | 2001-220050 | 8/2001 |
| JP | 2004-210534 | 7/2004 |
| JP | 2004-246056 | 9/2004 |
| JP | 2004-269165 | 9/2004 |
| JP | 2005-104676 | 4/2005 |

* cited by examiner

*Primary Examiner*—Judy Nguyen
*Assistant Examiner*—'Wyn' Q Ha
(74) *Attorney, Agent, or Firm*—Fitzpatrick, Cella, Harper & Scinto

(57) ABSTRACT

A sheet processing apparatus including: a conveying unit, which conveys a sheet; a stacking unit on which the conveyed sheet is stacked; a processing unit, which processes the stacked sheet; a buffering unit, which allows the sheet conveyed to the stacking unit by the conveying unit to pass, and buffers a predetermined number of sheets to be passed during an operation of the processing unit; a transferring unit, which receives the buffer sheets and transfers the predetermined number of buffer sheets from the buffering unit to the stacking unit; and a controlling unit, which controls a sheet conveying speed to make a speed when the transferring unit transfers the buffer sheet lower than a speed when the transferring unit receives the buffer sheets to prevent the sheet conveyed by the conveying unit from interfering the transferring unit during an operation of transferring the sheet.

11 Claims, 28 Drawing Sheets

SHEET PROCESSING APPARATUS AND IMAGE FORMING APPARATUS

BACKGROUND OF THE INVENTION

1. Field of the Invention

The present invention relates to a sheet processing apparatus capable of buffering (storing) a sheet supplied during a processing operation of a sheet processing unit, which processes a sheet, and to an image forming apparatus including the sheet processing apparatus in an apparatus main body thereof.

2. Description of the Related Art

Up to now, an apparatus main body of an image forming apparatus for forming an image on a sheet includes a sheet processing apparatus, which processes a sheet conveyed from the apparatus main body connected thereto or incorporated therein (see JP 2004-269165 A). As examples of the image forming apparatus, there are given an electrophotographic copying machine and a laser beam printer.

A conventional sheet processing apparatus has a structure in which, as shown in FIG. 22A, sheets each having an image formed thereon are sequentially supplied from the apparatus main body of the image forming apparatus, supplied sheets P are stacked on an intermediate tray 29 in a bundle, and then, for example, the sheets are stapled using a stapler (not shown). In this case, a sheet processing apparatus 19 cannot stack the sheets sequentially supplied from the apparatus main body of the image forming apparatus on the intermediate tray 29 while the stapler performs a stapling operation.

Accordingly, the sheet processing apparatus 19 buffers (stores) a predetermined number of sheets P1, P2, and P3 supplied during the stapler operation by a buffering unit 40 as shown in FIG. 22B (see JP 2004-269165 A, JP 2001-220050 A, JP 2004-210534 A, and JP 2004-246056 A). A buffered sheet is referred to as "buffer sheet", and the number of buffer sheets is three, for example.

The sheet processing apparatus shifts a stapled sheet bundle P to a downstream side by a distance L with respect to the buffer sheets P1, P2, and P3 by a trailing edge assist 34 as shown in FIG. 23A. After that, as shown in FIG. 23B, a rocking roller pair 27 nips the stapled sheet bundle P and the buffer sheets P1, P2, and P3 and conveys at the same time.

Finally, the rocking roller pair 27 rotates to deliver the stapled sheet bundle P onto a stack tray 28 (FIG. 24A), and reversely rotates to slide the buffer sheets P1, P2, and P3 downward on the intermediate tray 29 to be brought into abutment against a stopper 31 (FIG. 24B) Subsequent sheets are sequentially stacked on the buffer sheets, and when the predetermined number of sheets are stacked, the sheet bundle is stapled by the stapler. After the series of operations are repeated, the stapled sheet bundles are sequentially stacked on the stack tray 28.

Thus, in the conventional sheet processing apparatus, even when sheets are supplied while the sheet bundle is stapled by the stapler, the sheets are buffered to the buffering unit, thereby preventing a flow of the supplied sheet from being inhibited.

However, the conventional sheet processing apparatus has the following two problems.

(First Problem)

In recent years, with high productivity of an image forming apparatus, an image forming processing speed in an apparatus main body is increased, with the result that a distance between sheets supplied from the apparatus main body to the sheet processing apparatus becomes smaller.

As a result, as shown in FIG. 25, in a process in which the buffer sheets P1, P2, and P3 are slid downward on an intermediate tray 29 and brought into abutment against the stopper 31, a first sheet P1 of the subsequent sheet bundle may be conveyed thereto. However, at this time, the rocking roller pair 27 does not open since the rocking roller pair brings the buffer sheets into abutment against the stopper 31. Thus, the rocking roller pair 27 cannot receive the first sheet P1 of the subsequent sheet bundle. Accordingly, the first sheet P1 of the subsequent sheet bundle may be brought into abutment against rocking roller pair 27 and become a jammed sheet.

Accordingly, it is considered that processing such as stapling processing of a stapler, delivering processing of the stapled sheet bundle, and trailing edge aligning processing of bringing the buffer sheet into abutment against the stopper 31 is sped up. However, as the processing is sped up, a drive source of the apparatus is increased in size, thereby arising another problem in that it is difficult to reduce the entire apparatus in size.

(Second Problem)

In a case where the number of sheets of the sheet bundle is less than the number of buffer sheets to be buffered to the buffering unit, when the preceding sheet bundle is being stapled by the stapler, a sheet of the subsequent sheet bundle is supplied to the buffering unit, and further the first few sheets of the subsequent sheet bundle are also supplied. For this reason, there is a problem in that, when the subsequent sheet bundle is to be stapled, sheets of a further subsequent sheet bundle are also stapled together.

For example, it is assumed that a maximum number of buffer sheets which can be buffered to the buffering unit is three. When a bundle of two sheets which are lower then the maximum buffer sheet number, the two sheets of the sheet bundle are buffered in a first job. However, since the maximum buffer sheet number is three, one more sheet can be buffered. As a result, a first sheet of another sheet bundle is buffered in the next job. When the buffered sheets are stapled in this state, there arises a problem in that the two sheets of the sheet bundle in the first job and the one sheet of the subsequent sheet bundle in the next job are stapled together.

The above-mentioned problems arise not only in a sheet processing unit serving as a staple unit for stapling a sheet bundle, but also in a sheet processing unit serving as a punch unit for punching a sheet bundle.

The image forming apparatus including the sheet processing apparatus having the above-mentioned problems in the apparatus main body has a problem in that high productivity in image formation is inhibited by the sheet processing apparatus.

SUMMARY OF THE INVENTION

It is an object of the present invention to provide a sheet processing apparatus capable of receiving the subsequent sheet without causing jamming of the subsequent sheet even when the subsequent sheet is supplied while buffer sheets are transferred from a buffering unit to a stacking unit.

It is another object of the present invention to provide a sheet processing apparatus capable of processing sheet bundles for each job even when the number of sheets of a sheet bundle is less than the number of sheets to be buffered to the buffering unit.

It is another object of the present invention to provide an image forming apparatus including the sheet processing apparatus in the apparatus main body, and capable of attaining high productivity in forming an image on a sheet.

According to an aspect of the present invention, there is provided a sheet processing apparatus including: a conveying unit, which conveys a sheet; a stacking unit on which the sheet conveyed by the conveying unit is stacked; a processing unit, which processes the sheet stacked on the stacking unit; a buffering unit, which allows the sheet conveyed to the stacking unit by the conveying unit to pass, and buffers a predetermined number of sheets to be passed during an operation of the processing unit; a transferring unit arranged in a region for the buffer sheet buffered to the buffering unit, for receiving the buffer sheets and transferring the predetermined number of buffer sheets from the buffering unit to the stacking unit after the predetermined number of buffer sheets are buffered; and a controlling unit, which controls a sheet conveying speed of the conveying unit, in which the controlling unit controls the sheet conveying speed obtained when the transferring unit transfers the buffer sheet to set to be lower than the sheet conveying speed obtained when the transferring unit receives the buffer sheets so that the sheet conveyed by the conveying unit is prevented from interfering the transferring unit during an operation of transferring the sheet.

According to another aspect of the present invention, there is provided a sheet processing apparatus including: a conveying unit, which conveys a sheet; a stacking unit on which the sheet conveyed by the conveying unit is stacked; a processing unit, which processes the sheet stacked on the stacking unit; and a buttering unit, which buffers a predetermined number of sheets to be conveyed to the stacking unit by the conveying unit during an operation of the processing unit; and a controlling unit which controls conveyance of the sheet by the conveying unit, in which the controlling unit controls the conveyance of the sheet when the number of job sheets to be processed by the processing unit is less than the predetermined number of buffer sheets to buffer only sheets corresponding to the number of job sheets to the buffering unit so that the processing unit can process the sheets for each one job.

According to another aspect of the present invention, there is provided an image forming apparatus including: a conveying unit, which conveys a sheet; an image forming portion, which forms an image on a sheet; a stacking unit on which the sheet conveyed by the conveying unit is stacked; a processing unit, which processes the sheet stacked on the stacking unit; a buffering unit, which allows the sheet conveyed to the stacking unit by the conveying unit to pass, and buffers a predetermined number of sheets to be passed during an operation of the processing unit; a transferring unit arranged in a region for the buffer sheet buffered to the buffering unit, for receiving the buffer sheets and transferring the predetermined number of buffer sheets from the buffering unit to the stacking unit after the predetermined number of buffer sheets are buffered; and a controlling unit, which controls a sheet conveying speed of the conveying unit, in which the controlling unit controls the sheet conveying speed obtained when the transferring unit transfers the buffer sheet to set to be lower than the sheet conveying speed obtained when the transferring unit receives the buffer sheets so that the sheet conveyed by the conveying unit is prevented from interfering the transferring unit during an operation of transferring the sheet.

According to another aspect of the present invention, there is provided an image forming apparatus including: a conveying unit, which conveys a sheet; an image forming portion, which forms an image on a sheet; a stacking unit on which the sheet conveyed by the conveying unit is stacked; a processing unit, which processes the sheet stacked on the stacking unit; and a buffering unit, which buffers a predetermined number of sheets to be conveyed to the stacking unit by the conveying unit during an operation of the processing unit; and a controlling unit, which controls conveyance of the sheet by the conveying unit, in which the controlling unit controls the conveyance of the sheet when the number of job sheets to be processed by the processing unit is less than the predetermined number of buffer sheets to buffer only sheets corresponding to the number of job sheets to the buffering unit so that the processing unit can process the sheets for each one job.

In the sheet processing apparatus according to another aspect of the present invention, the sheet conveying speed of the conveying unit when the transferring unit transfers the buffer sheets is set to be lower than the sheet conveying speed of the conveying unit when the transferring unit receives the buffer sheets.

For this reason, even when the subsequent sheet is supplied while the buffer sheets are transferred from the buffering unit to the stacking unit, the sheet processing apparatus can receive the subsequent sheet without causing sheet jamming.

In the sheet processing apparatus according to another aspect of the present invention, the sheet conveying speed obtained when the number of job sheets is less than the number of buffer sheets is set to be lower than the sheet conveying speed obtained when the number of job sheets is equal to or more than the number of buffer sheets, to thereby buffer only sheets for the number of the job sheets to the buffering unit. Specifically, for example, the problem, as described in the "Second Problem", in that the two sheets of the sheet bundle in the first job and the first sheet of the subsequent sheet bundle in the next job are processed together can be prevented, and it is possible to process the sheets for every two sheets, that is, for each job.

As a result, in the sheet processing apparatus, it is possible for the sheet processing unit to perform the sheet processing for each one job.

In the image forming apparatus according to another aspect of the present invention, the sheet conveying speed of the conveying unit when the transferring unit transfers the buffer sheets is set to be lower than the sheet conveying speed of the conveying unit when the transferring unit receives the buffer sheets.

For this reason, even when the subsequent sheet is supplied while the buffer sheets are transferred from the buffering unit to the stacking unit, the image forming apparatus can receive the subsequent sheet without causing sheet jamming.

In the image forming apparatus according to another aspect of the present invention, the sheet conveying speed obtained when the number of job sheets is less than the number of buffer sheets is set to be lower than the sheet conveying speed obtained when the number of job sheets is equal to or more than the number of buffer sheets, to thereby buffer only sheets for the number of the job sheets to the buffering unit.

As a result, in the image forming apparatus, it is possible for the sheet processing unit to perform the sheet processing for each one job.

Further features of the present invention will become apparent from the following description of exemplary embodiments with reference to the accompanying drawings.

DESCRIPTION OF THE EMBODIMENTS

Hereinafter, a sheet processing apparatus according to an embodiment of the present invention, and a copying machine as an example of an image forming apparatus including the sheet processing apparatus in an apparatus main body will be described with reference to the drawings.

As examples of the image forming apparatus, there are given a copying machine, a facsimile machine, a printer, and a combined machine having those functions, and the image forming apparatus including the sheet processing apparatus is not limited to a copying machine.

Dimensions, numerical values, materials, shapes, relative arrangement, and the like of components according to this embodiment are not intended to limited thereto in the range of the present invention unless specific description is made.

In this embodiment, a case where the sheet processing apparatus is an optional apparatus detachably mounted to the apparatus main body of the image forming apparatus as an independent apparatus is described as an example. The sheet processing apparatus according to the present invention is applied to a case where the sheet processing apparatus is integrally mounted to the image forming apparatus as a matter of course. However, the case is not particularly different from the case of the sheet processing apparatus to be described below in functions, so description thereof is omitted.

Further, the numerical values used in this embodiment are reference values, so the present invention is not limited to the numeral values.

(Image Forming Apparatus)

Figure 1:
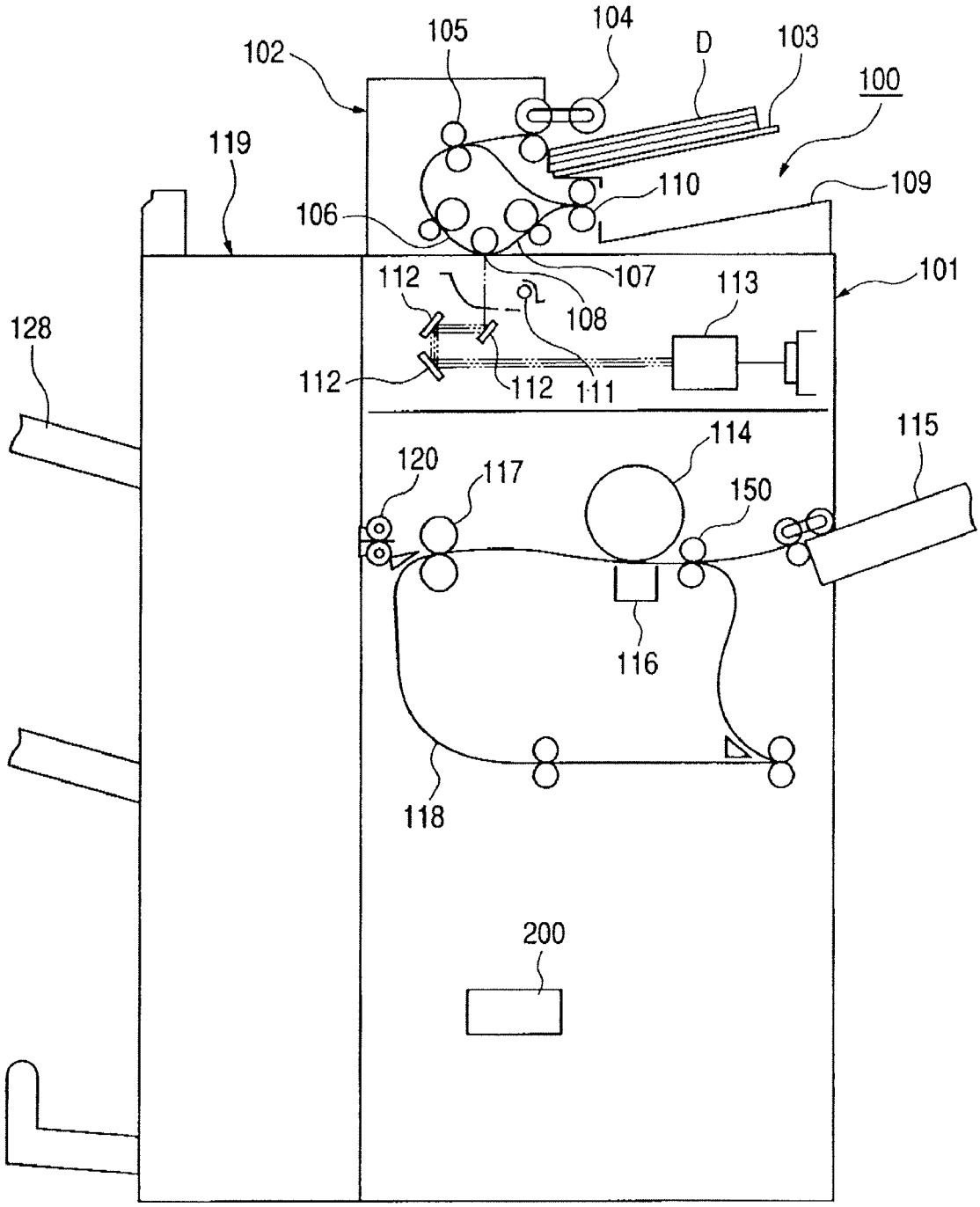
FIG. 1 is a cross-sectional front view schematically illustrating a copying machine serving as an image forming apparatus including a sheet processing apparatus according to an embodiment of the present invention in an apparatus main body.

FIG. 1 is a cross-sectional front view schematically illustrating a copying machine serving as an image forming apparatus including a sheet processing apparatus according to an embodiment of the present invention in an apparatus main body. The sheet processing apparatus is specifically, for example, a finisher.

A copying machine 100 includes an apparatus main body 101 and a sheet processing apparatus 119. On an upper part of the apparatus main body 101, an original feeding device 102 is provided. The original feeding device 102 is not necessarily provided. An original may be loaded on the upper part of the apparatus main body 101 to read the original without providing the original feeding device 102.

Originals D are loaded on an original loading portion 103 by a user and the loaded originals are separately supplied to a registration roller pair 105 one by one by a sheet feeding portion 104. Subsequently, the original D is temporarily stopped being supplied by the registration roller pair 105, and skew of the original is corrected by forming a loop. After that, the original D passes through a guide pass 106 and passes through a reading position 108, thereby reading an image formed on a front surface of the original. The original D passing through the reading position 108 passes through a delivery path 107 and is delivered onto a delivery tray 109.

In a case where both surfaces of the original are read, first, the original D passes through the reading position 108 to read an image formed on one surface of the original as described above. After that, the original D passes through the delivery path 107, is subjected to switchback conveyance by the a reverse roller pair 110, and is fed to the registration roller pair 105 again in a state where the both surfaces of the original are reversed.

Then, similar to the operation of reading the image formed on one surface of the original, the skew of the original D is corrected by the registration roller pair 105, and passes through the guide path 106, thereby reading an image formed on the other surface of the original at the reading portion 108. The original D passes through the delivery path 107 and is delivered onto the delivery tray 109.

On the other hand, the image formed on the original passing through the reading position 108 is applied with light by an illumination system 111. Reflected light from the original is guided to an optical element (CCD or another element) 113 by mirrors 112, to thereby obtain image data. Then, laser light based on the image data is applied to a photosensitive drum 114 to form a latent image. Note that, though not illustrated in the Figures, the reflected light may be applied directly to the photosensitive drum 114 by the mirrors 112 to form the latent image.

Further, the latent image formed on the photosensitive drum 114 is developed into a toner image using toner supplied from a toner supply device (not shown). In a cassette 115, a recording medium such as paper or a plastic film is stacked. The sheet is fed from the cassette 115 in response to a recording signal, and enters between the photosensitive drum 114 and a transfer device 116 at a certain timing by the registration roller pair 150. Then, the toner image formed on the photosensitive drum 114 is transferred onto the sheet by the transfer device 116. The toner image is fixed onto the sheet having the toner image transferred thereto through heating and pressurization by a fixing device 117 while the sheet passes through the fixing device 117.

In a case where images are formed on both surfaces of the recording medium, the sheet having an image fixed on one surface thereof by the fixing device 117 passes through a duplex path 118 provided on a downstream side of the fixing device 117, and is fed between the photosensitive drum 114 and the transfer device 116 again, thereby transferring the toner image also on a back surface of the sheet. Then, the toner image is fixed on the sheet by the fixing device 117 and the sheet is delivered to an outside (finisher 119 side).

Figure 2:
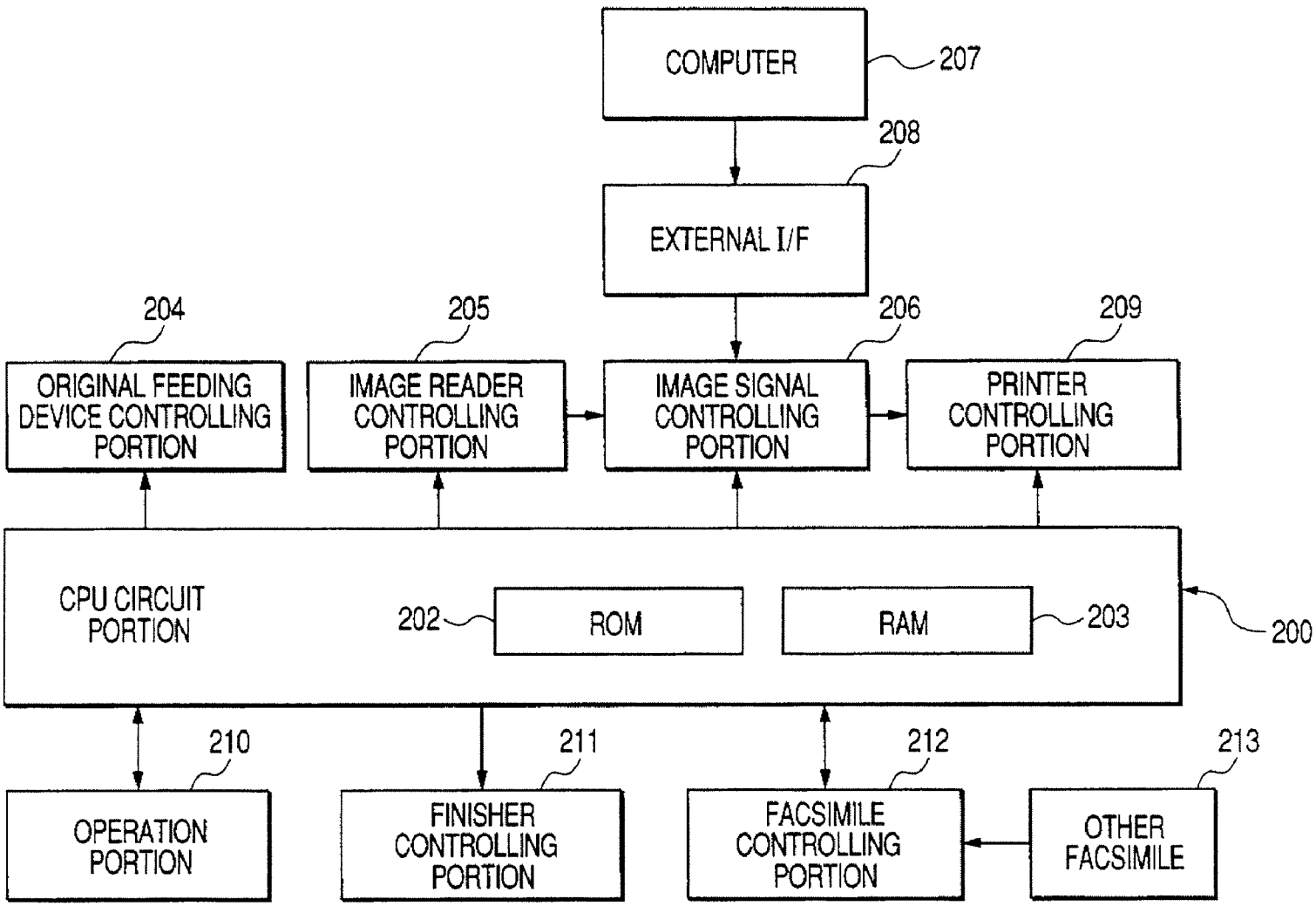
FIG. 2 is a control block diagram of the copying machine of FIG. 1.

FIG. 2 is a control block diagram of the copying machine. The entire copying machine 100 is controlled by a CPU 200. The CPU 200 includes a ROM 202 storing sequence of each element, that is, a control sequence, and a RAM 203 temporarily storing various information as needed. An original feeding device controlling portion 204 controls an original feeding operation of the original feeding device 102. An image reader controlling portion 205 controls the illumination system 111 and the like to control reading of the original. An image signal controlling portion 206 receives image information send from an external computer 207 through an external I/F 208, the information is then processed, and a processing signal is sent to a printer controlling portion 209. The printer controlling portion 209 controls the photosensitive drum 114 and the like based on the image processing signal from the image signal controlling portion 206 so that an image is formed on the sheet.

An operation portion 210 can receive sheet size information for a case where the user uses the copying machine, information on what processing is to be performed with respect to the sheet, for example, performing stapling processing. In addition, the operation portion 210 can display information on operation states and the like of the apparatus main body 101 of the copying machine or the finisher 119 serving as a sheet post-processing apparatus. A finisher controlling portion 211 controls an operation in the finisher 119 serving as the post-processing apparatus. A facsimile controlling portion 212 controls the copying machine so that the copying machine can be used as a facsimile, and allows transmission/reception of the signal to/from other facsimile 213.

(Sheet Processing Apparatus)

Figure 3:
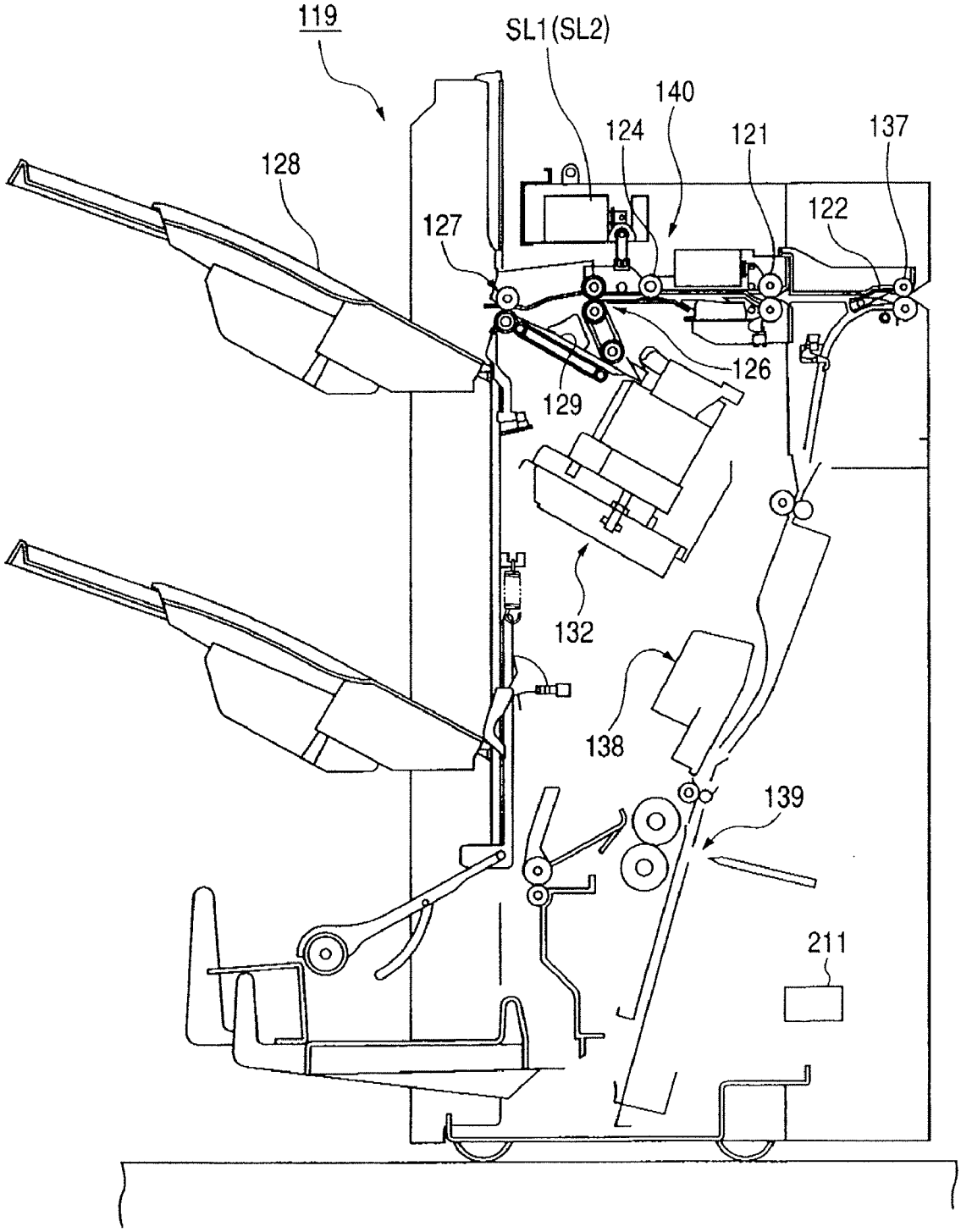
FIG. 3 is a cross-sectional front view schematically illustrating a sheet processing apparatus according to an embodiment of the present invention in an apparatus main body.
Figure 4:
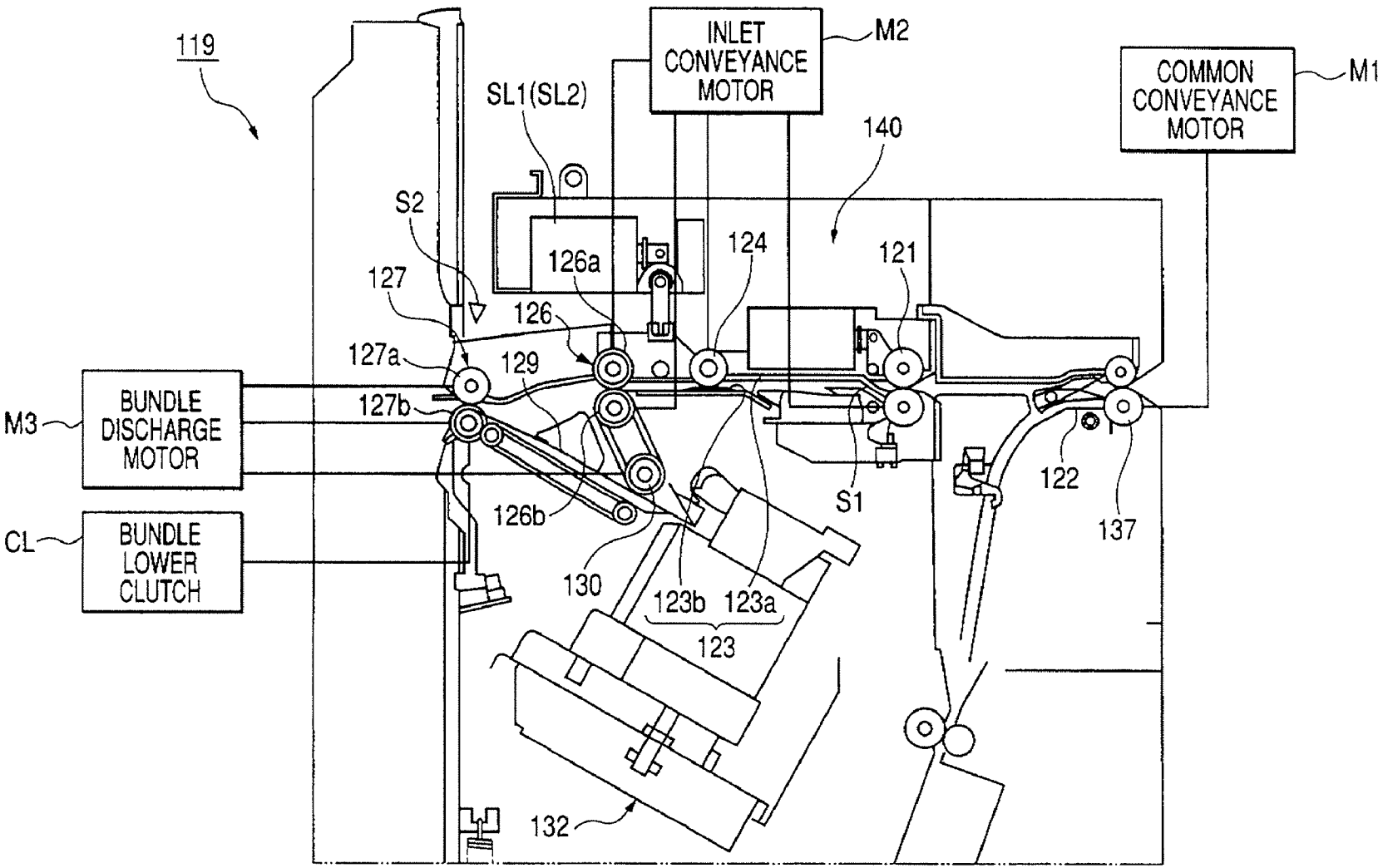
FIG. 4 is a cross-sectional front view schematically illustrating drive systems of the sheet processing apparatus according to an embodiment of the present invention in an apparatus main body.
Figure 5:
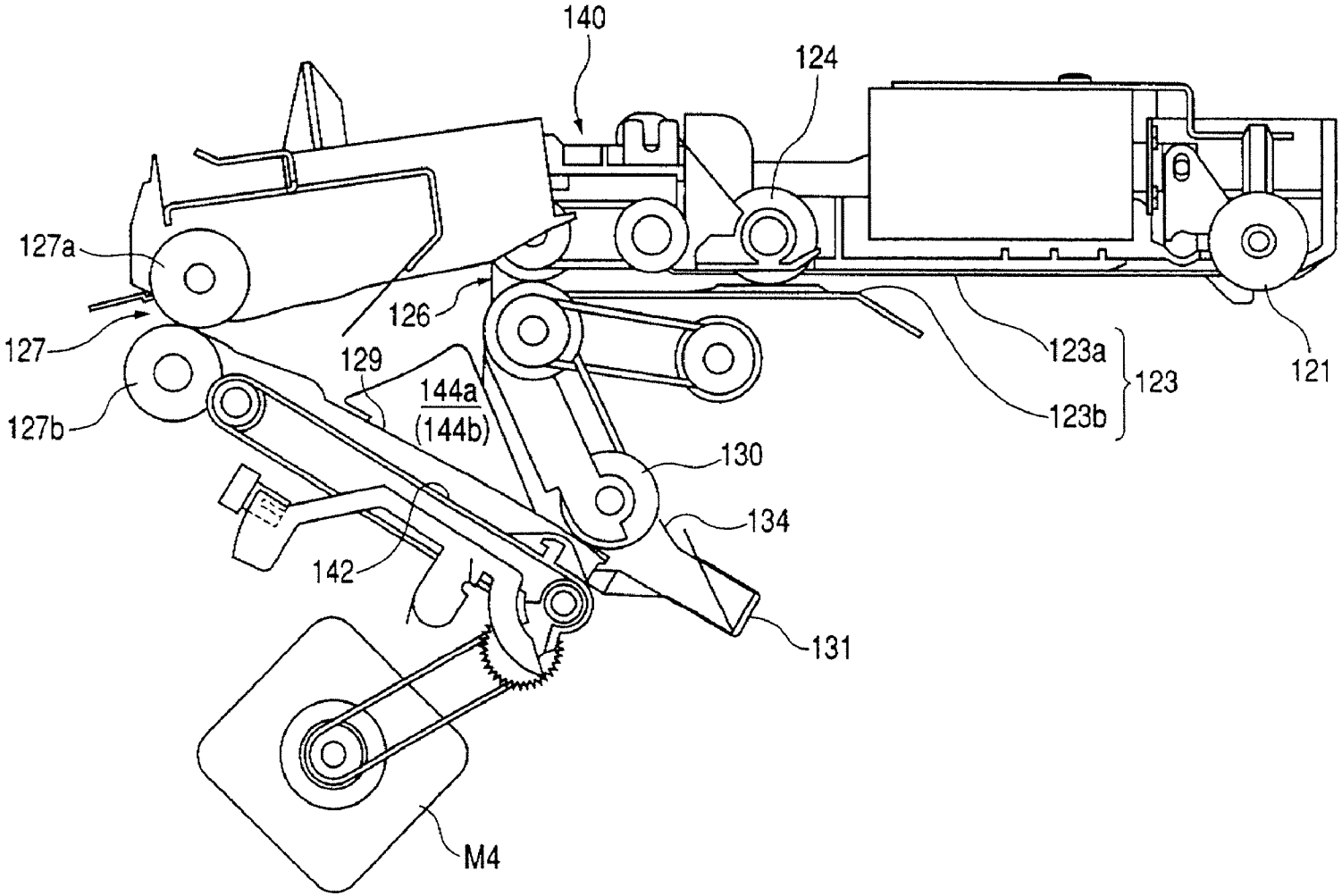
FIG. 5 is an enlarged view illustrating a main part of the sheet processing apparatus according to an embodiment of the present invention.
Figure 6:
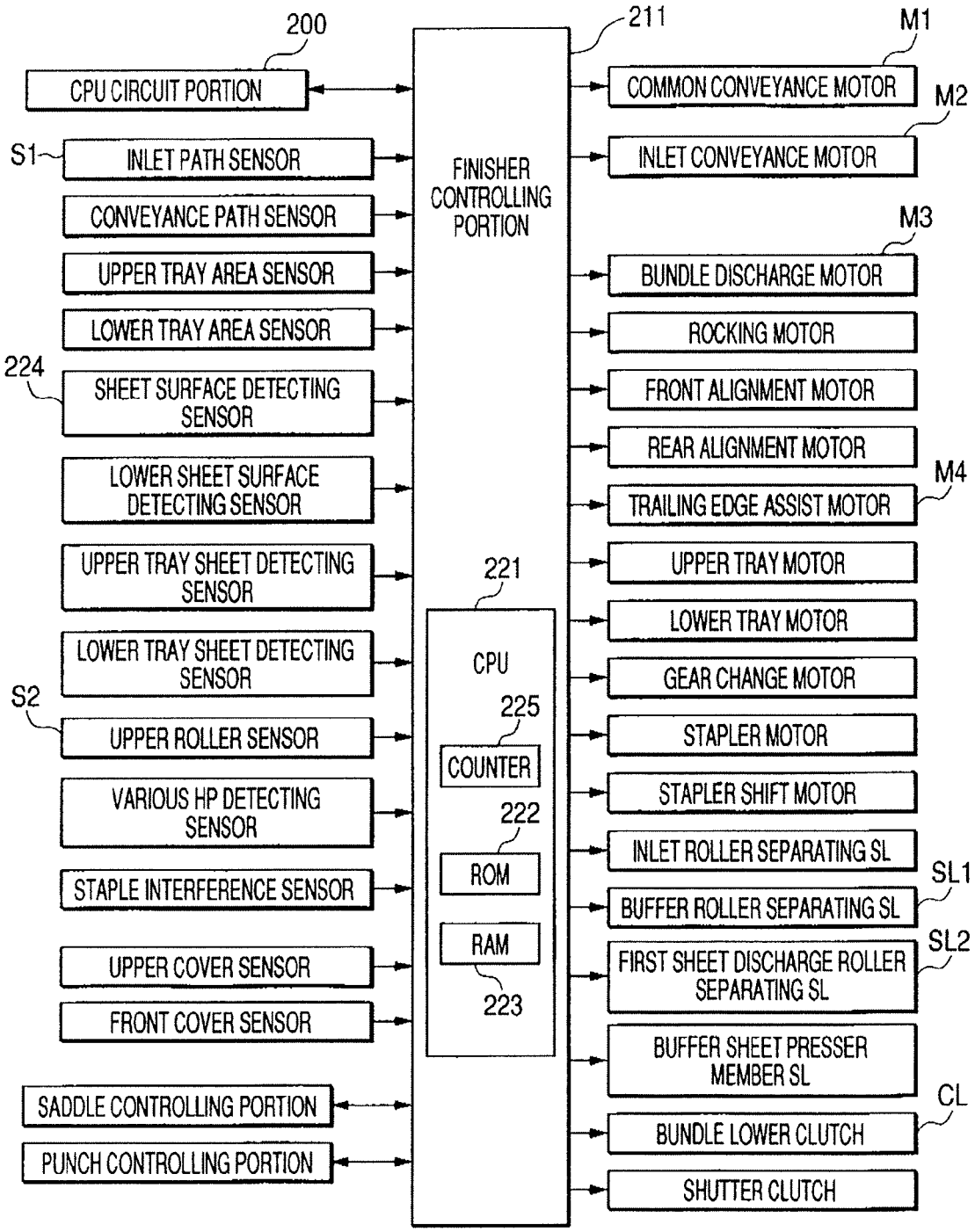
FIG. 6 is a control block diagram illustrating the sheet processing apparatus of FIG. 3.

FIG. 3 is a cross-sectional view taken along a sheet conveyance direction of the sheet processing apparatus. FIG. 4 is a longitudinal sectional view illustrating driving systems. FIG. 5 is an enlarged view of a main part of the sheet processing apparatus. FIG. 6 is a control block diagram of the sheet processing apparatus.

A sheet processing apparatus 119 has a function of bookbinding a sheet bundle in a book form. The sheet processing apparatus 119 includes a stapler unit 132, which staples the vicinity of the edge of the sheet bundle, a stapler 138, which staples the center of the sheet bundle, and a folding unit 139 for folding the sheet bundle stapled by the stapler 138 in the stapled portion.

The sheet processing apparatus 119 according to this embodiment includes a buffering unit 140 for superimposing a plurality of sheets in a state where the sheets are not folded and buffering the sheets at the operation of the stapler unit 132.

The buffering unit 140 superimposes a plurality of sheets in a state where the sheets are not folded and buffers the sheets, so the buffering unit 140 is made flat, unlike the conventional mechanism, for example, having a buffer roller, thereby making it possible to reduce in size and weight of the sheet processing apparatus. Further, it is possible to buffer the sheets in the state where the sheets are not folded, so the sheet can be easily treated without rolling the sheet, unlike the case of the buffer roller, thereby making it possible to reduce a sheet processing time as the sheet processing apparatus.

The sheet processing apparatus 119 is controlled by the finisher controlling portion 211 shown in FIGS. 2 and 6. The CPU 221 of the finisher controlling portion 211 includes a ROM 222 and a RAM 223. The ROM 222 stores a control sequence of the sheet processing apparatus 119 for operating in response to an instruction from a CPU circuit portion 200 of the apparatus main body of the copying machine. The RAM 223 stores information necessary for controlling the sheet processing apparatus 119 each time.

Further, the finisher controlling portion 211 is connected to a sheet surface detecting sensor 224 operating according to an operation of a sheet surface detecting lever 133 to be described later, an inlet path sensor S1 disposed in the vicinity of the downstream side of an inlet roller pair 121, and an upper roller sensor S2 for detecting descending of an upper roller 17*a*. A CPU 221 controls descending/ascending of stack trays 128 in response to a sheet detection signal of the sheet surface detecting sensor 224. The finisher controlling portion 211 controls a common conveyance motor M1, an inlet conveyance motor M2, a bundle discharge motor M3, a trailing edge assist motor M4, a buffer roller separating plunger SL1, a first sheet discharge roller separating plunger SL2, a bundle lower clutch CL, and the like.

The common conveyance motor M1 is a motor for rotating a receiving roller pair 137 and a delivery roller pair 120. The inlet conveyance motor M2 is a motor for rotating the inlet roller pair 121, a buffer roller 124, and a first sheet discharge roller pair 126. The bundle discharge motor M3 is a motor for rotating a rocking roller pair 127 and a return roller 130. The trailing edge assist motor M4 is a motor for moving a trailing edge assist 134.

The buffer roller separating plunger SL1 is a plunger for separating the buffer roller 124 from a lower conveyance guide plate 123*b*. The first sheet discharge roller separating plunger SL2 is a plunger for separating an upper first sheet discharge roller 126*a* of the first sheet discharge roller pair 126 from a lower first sheet discharge roller 126*b*.

The bundle lower clutch CL is a clutch for transferring or blocking rotation of the bundle discharge motor M3 to/from a lower roller 127*b* to be described later. The lower roller 127*b* and the return roller 130 are rotated by the shared motor M3, which causes a slip between the lower roller 127*b* and the return roller 130 or causes a difference of a sheet conveyance speed between rollers when a sheet or a sheet bundle is conveyed. For this reason, the bundle lower clutch CL is provided so as to prevent the sheet or the sheet bundle from causing wrinkles or breakage.

The CPU circuit portion 200 and the finisher controlling portion 211 may be integrated with each other.

(Description of Operation of Sheet Processing Apparatus)

The operation of the sheet processing apparatus will be described with reference to structural diagrams of FIGS. 1, 3 to 5, and 7A to 14B, and control block diagrams of FIGS. 2 and 6.

When a user selects sheet stapling processing display of the operation portion 210 (see FIG. 2) of the copying machine 100. The CPU circuit potion 200 controls each component of the apparatus main body 101 to shift the copying machine 100 to a copying operation, and sends a sheet stapling processing signal to the finisher controlling portion 211.

The finisher controlling portion 211 starts the inlet conveyance motor M2 and the bundle discharge motor M3 in response to the sheet stapling processing signal. The finisher controlling portion 211 operates the buffer roller separating plunger SL1 (see FIG. 4) to separate the buffer roller 124 from a lower conveyance guide plate 123*b*, and further a plunger (not shown) is operated to separate an upper roller 127*a* of the rocking roller pair 127 from the lower roller 127*b*. Start and Stop of the inlet conveyance motor M2 and the bundle discharge motor M3 may be sequentially controlled according to movement of the sheet.

Figure 7A:
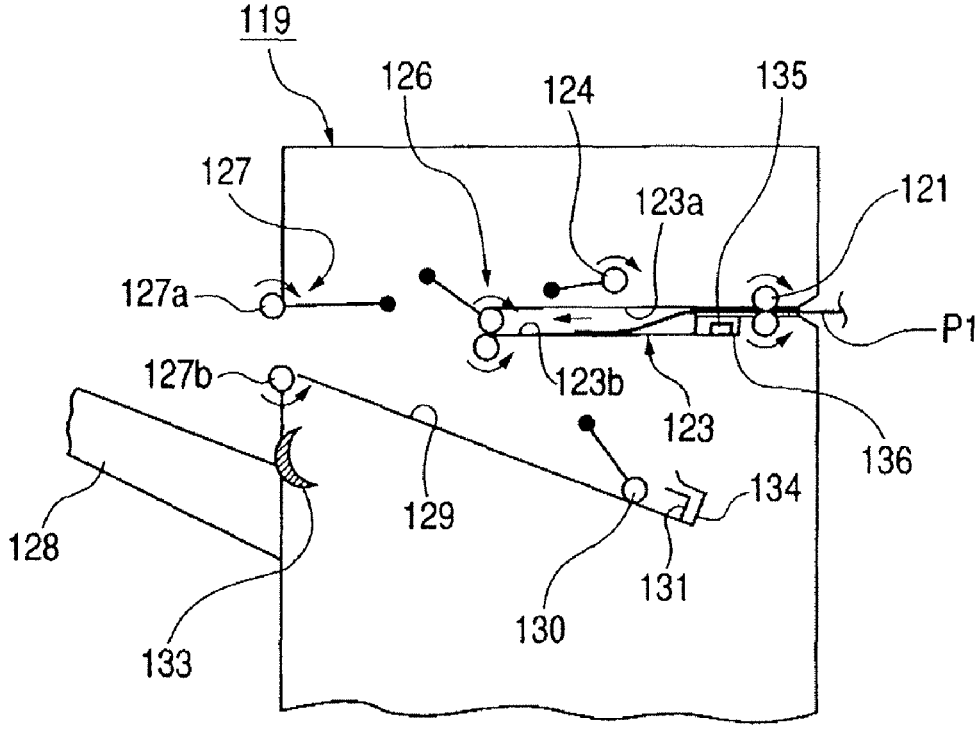
FIG. 7A is a diagram illustrating an operation of the sheet processing apparatus in a case where a sheet is not required to be buffered during sheet processing, and in a state where a first sheet is fed into the sheet processing apparatus.

A first sheet sent from the delivery roller pair 120 of the apparatus main body 101 of the copying machine 100 (see FIG. 1) is conveyed by the receiving roller pair 137 shown in FIGS. 3 and 4, is guided by a flapper 122, and is conveyed to the inlet roller pair 121. The receiving roller pair 137 is rotated by the common conveyance motor M1 for rotating the delivery roller pair 120. The inlet roller pair 121 is rotated by the inlet transport motor M2 (see FIG. 4). As shown in FIG. 7A, a sheet P1 is guided by a guide 123 including an upper conveyance guide plate 123*a* and the lower conveyance guide plate 123*b* to be conveyed to the first delivery roller pair 126.

Figure 7B:
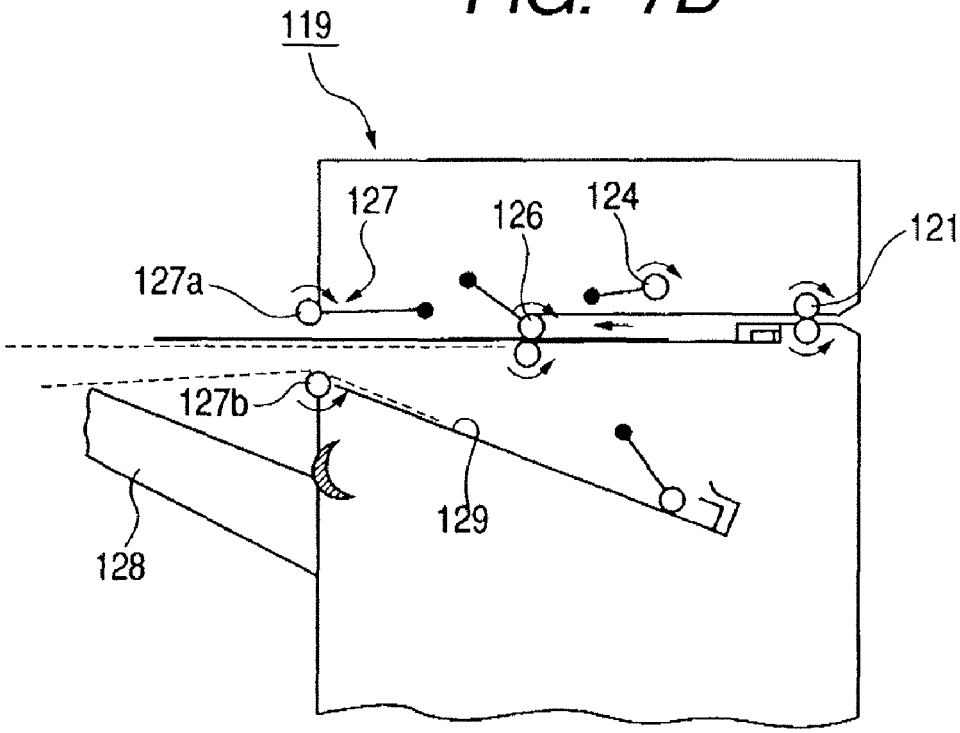
FIG. 7B is a diagram illustrating an operation of the sheet processing apparatus in a case where a sheet is not required to be buffered during sheet processing, and in a state where a first sheet is received by the sheet processing apparatus.
Figure 8A:
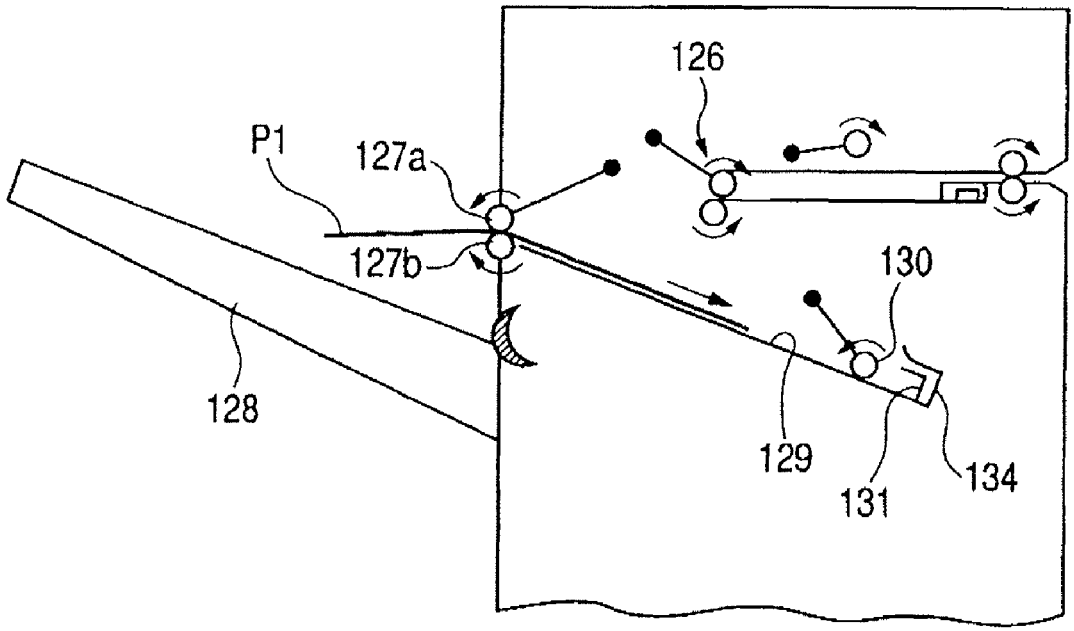
FIG. 8A is a diagram illustrating an operation of the sheet processing apparatus, which follows the operation of FIG. 7B, in a case where a sheet is not required to be buffered during sheet processing, and in a state where the first sheet is further fed to a sheet processing tray.

As shown in FIG. 7B, the sheet P1 is further conveyed through rotation of the first delivery roller pair 126, about half of the sheet P1 is discharged in a direction of the stack tray 128, and the sheet P1 falls across the stack tray 128 and a processing tray 129. After that, as shown in FIG. 8A, the upper roller 127*a* descends by a plunger (not shown), and nips the sheet with the lower roller 127*b*.

At this time, the upper roller 127*a* has been rotating in a direction indicated by an arrow (FIG. 8A) by the bundle discharge motor M3 (FIG. 4). Further, the return roller 130 provided so as to be brought into contact with/separated from the processing tray 129 is also rotated in a direction indicated by the arrow (FIG. 8A) by the bundle discharge motor M3 (FIG. 4). The lower roller 127*b* receives a drive force by the operation of the bundle lower clutch CL (see FIG. 4) when the first sheet is processed, and slips when the second sheet and the subsequent sheets are processed. This is because, when the second sheet and the subsequent sheets stacked on the processing tray after the first sheet loaded thereon, and the lower roller 127*b* is rotated, the lower roller 127*b* presses the first sheet onto the stopper 131 side, whereby causing wrinkles on the first sheet.

Figure 8B:
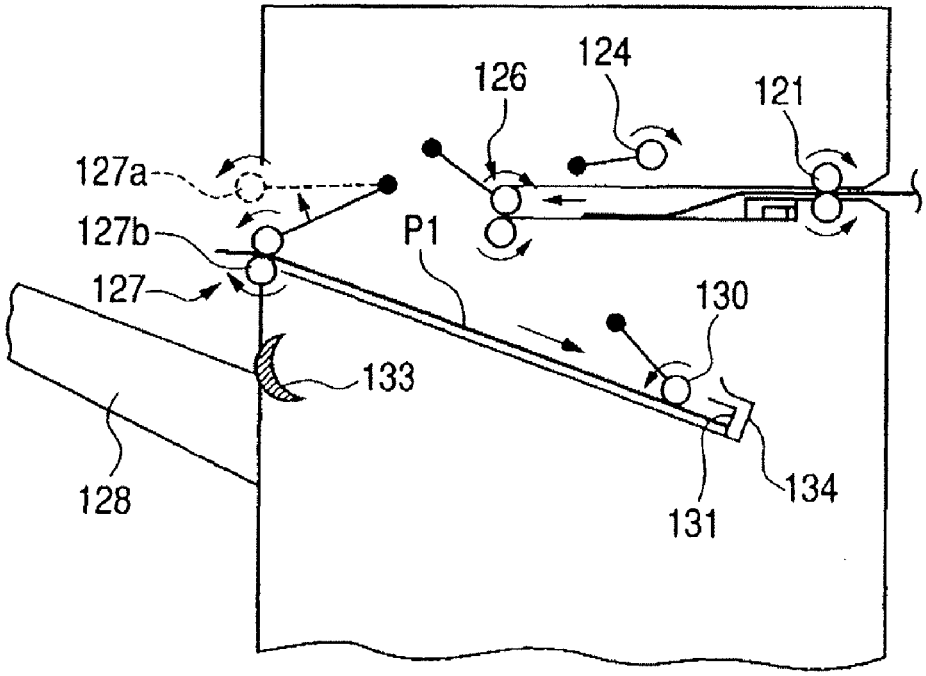
FIG. 8B is a diagram illustrating an operation of the sheet processing apparatus in a case where a sheet is not required to be buffered during sheet processing, and in a state where the first sheet is brought into abutment against a stopper.

As shown in FIG. 8B, through rotation of the rocking roller pair 127 and the return roller 130, the sheet slips and falls in the direction indicated by the arrow onto the processing tray 129 provided with an inclination in the lower right direction. At this time, the trailing edge assist 134 waits at a waiting position. Then, before the sheet P1 is brought into contact with a stopper 131, the upper roller 127*a* is separated from the sheet P1. The sheet P1 is brought into abutment against the stopper 131 by the return roller 130. After that, alignment of widths of the sheets is performed by a pair of alignment plates 144*a* and 144*b* (see FIG. 5).

Figure 9:
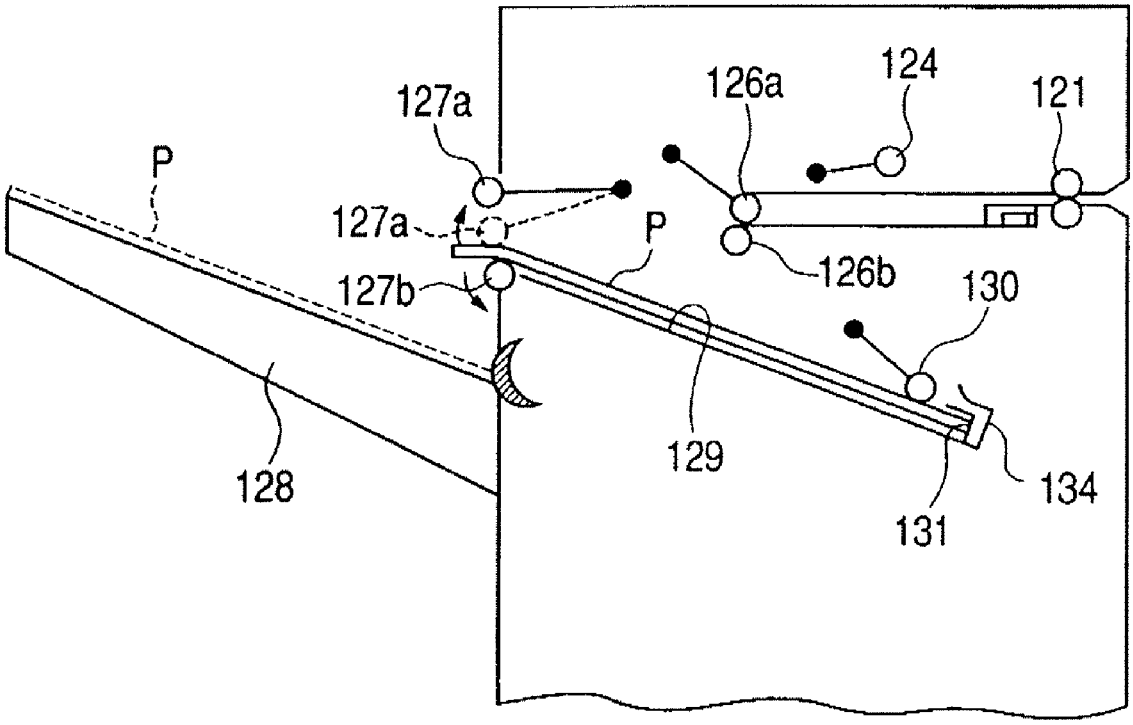
FIG. 9 is a diagram illustrating an operation of the sheet processing apparatus in a case where a sheet is not required to be buffered during sheet processing, and in a state where three sheets are stacked on a tray.

Hereinafter, the subsequent sheets are stacked on the processing tray 129 in the same manner as described above. As shown in FIG. 9, when a predetermined number of sheets are stacked on the processing tray 129, the sheets as a bundle are stapled by the stapler unit 132 shown in FIGS. 3 and 4.

After that, the upper roller 127*a* descends by a plunger (not shown) and nips a sheet bundle P with the lower roller 127*b* and rotates in the direction indicated by the arrow. The trailing edge assist 134 presses the trailing edge of the sheet bundle P and delivers the sheet bundle onto the stack tray 128. As shown in FIG. 5, the trailing edge assist 134 is provided to a belt 142, which rotates in the forward and backward directions by the trailing edge assist motor M4.

(Description of Buffer Operation)

In the above description of the operation, the operation in a case where a conveying distance between sheets is large and a sheet bundle can be subjected to stapling processing before the subsequent sheet is fed is described. The operation to be described below is a buffering operation in a case where a conveying distance between sheets is small, and the subsequent sheet is stored (buffered) only during stapling processing and aligning processing in a case where the subsequent sheet is fed when the sheet bundle is processed.

The sheet processing apparatus 119 performs buffering operation in response to a buffering operation command of the finisher controlling portion 211 when the CPU circuit portion 200 of the apparatus main body determines that a distance between sheets fed from the apparatus main body 101 of the copying machine 100 is smaller than the sheet stapling processing time. In this case, the buffer roller 124 descends to come into contact with the lower conveyance guide plate 123*b* by the buffer roller separating plunger SL1 (see FIG. 4).

Figure 10A:
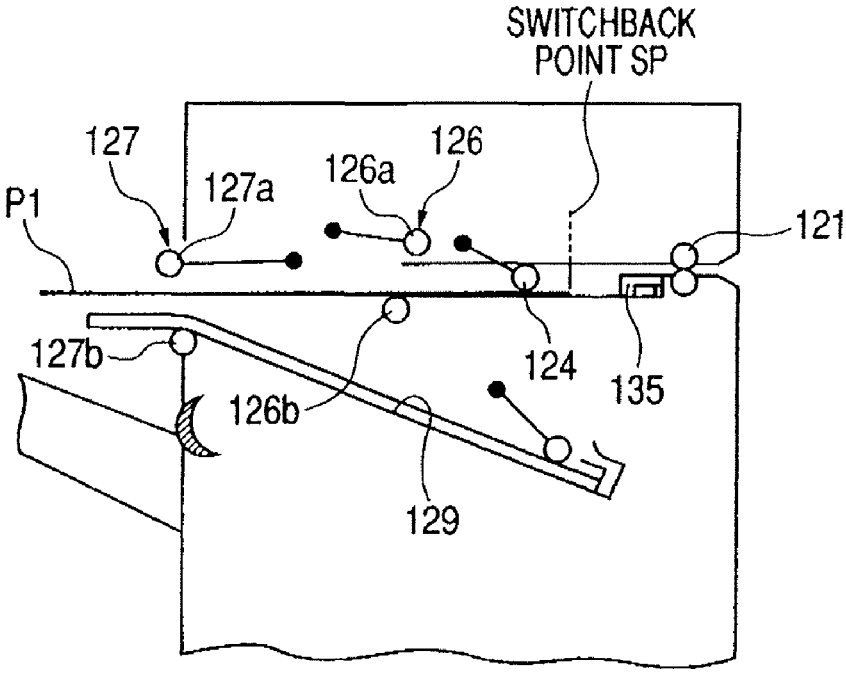
FIG. 10A is a diagram illustrating an operation of the sheet processing apparatus in a case where a sheet is to be buffered during sheet processing, and in a state where the first sheet is fed to a switchback point.

As shown in FIG. 10A, while the sheet bundle P stacked on the processing tray 129 is subjected to stapling processing, when the first sheet P1 in the subsequent sheet bundle is fed, the sheet P1 is fed to the buffer roller 124 by the inlet roller pair 121. The buffer roller 124 is rotated by the inlet conveyance motor M2 (see FIG. 4) to convey the sheet P1 downstream. At this time, the upper first sheet discharge roller 126*a* of the first sheet discharge roller pair 126 is separated from the lower first sheet discharge roller 126*b* by the first roller separating plunger SL2 (see FIG. 4). In FIG. 4, the first discharge roller separating plunger SL2 is overlapped with the buffer roller separating plunger SL1, the first discharge roller separating plunger SL2 is not shown in FIG. 4. In addition, the upper roller 127*a* of the rocking roller pair 127 is also separated from the lower roller 127*b* by a plunger (not shown).

Figure 10B:
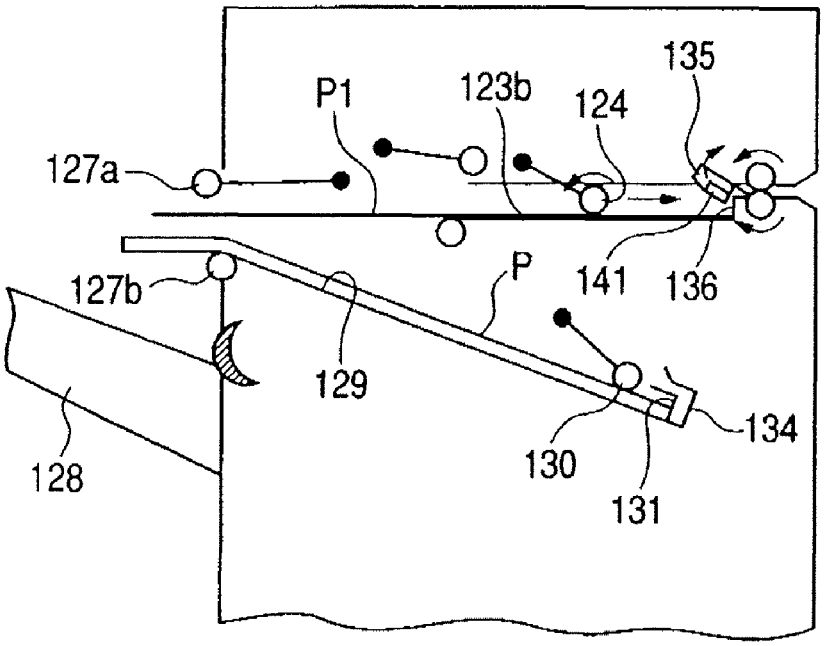
FIG. 10B is a diagram illustrating an operation of the sheet processing apparatus in a case where a sheet is to be buffered during sheet processing, and in a state where the first sheet is received by a trailing-edge receiving portion.

When the trailing edge of the sheet P1 reaches a switchback point SP, the trailing edge of the sheet P1 is returned to the upstream side through reverse rotation of the buffer roller 124 as shown in FIG. 10B. Substantially simultaneously, a trailing edge pressure member 135 is separated from the lower conveyance guide plate 123*b* and the trailing edge reception portion 136 is opened. Reaching of the sheet at the switchback point SP can be detected after a predetermined time, following which the inlet path sensor S1 disposed in the vicinity of the downstream side of the inlet roller pair 121 is operated to detect a leading edge (edge on the downstream side) of the sheet, or by the number of rotations of the buffer roller 124.

The upstream edge side of the sheet P1 after the downstream edge of the sheet has been detected, is received by the trailing edge reception portion 136 as shown in FIG. 10B. After that, the trailing edge pressure member 135 returns to the original position, and presses the sheet P1 against the lower conveyance guide plate 123*b* with a frictional member 141.

Figure 11A:
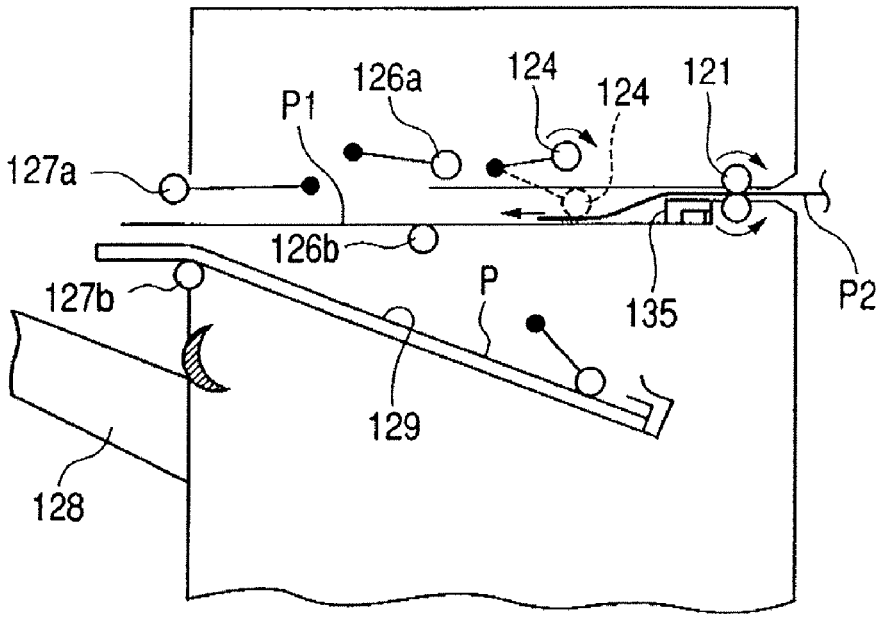
FIG. 11A is a diagram illustrating an operation of the sheet processing apparatus, which follows the operation of FIG. 10B, in a case where a sheet is to be buffered during sheet processing, and in a state where a second sheet is fed into the sheet processing apparatus.

After that, as shown in FIG. 11A, a second sheet P2 is fed into the sheet processing apparatus. The second sheet P2 is conveyed by the inlet roller pair 121. At this time, the sheet P2 passes above the trailing edge pressure member 135. Then, the sheet P2 is conveyed also by the buffer roller 124.

In this case, the first sheet P1 as well as the second sheet P2 are pressed against the lower conveyance guide plate 123*b*, and the first sheet P1 follows the second sheet P2 to be conveyed so as to move to the downstream side. However, the first sheet P1 pressed against the lower conveyance guide 123*b* by the frictional member 141 provided to the trailing edge pressure member 135. Thus, the first sheet P1 is not moved.

The second sheet P2 is also returned to the upstream side in the same manner as in the first sheet P1 when the trailing edge of the second sheet P2 reaches the switchback point SP. Then, the second sheet P2 is overlapped with the first sheet S1 and is pressed against the lower conveyance guide plate 123*b* by the frictional member 141 of the trailing edge pressure member 135.

Figure 11B:
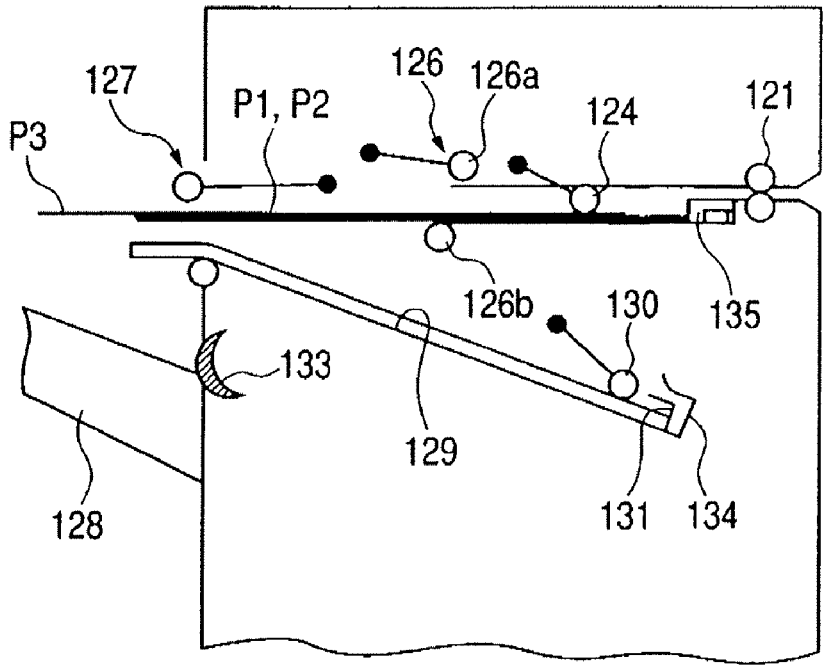
FIG. 11B is a diagram illustrating an operation of the sheet processing apparatus, in a case where a sheet is to be buffered during sheet processing, and in a state where a third sheet is fed into the sheet processing apparatus.

After that, as shown in FIG. 11B, a third sheet P3 is fed into the sheet processing apparatus. When the trailing edge of the sheet P3 passes through the inlet roller pair 121, the upper first sheet discharge roller 126*a* nips the first to third sheets with the lower first sheet discharge roller 126*b*. At this time, the third sheet P3 protrudes to the downstream side to a certain extent as compared with the first sheet P1 and the second sheet P2. The buffered three sheets are called buffer sheets. In this embodiment, the buffer sheets are three sheets as an example, but the number of sheets is not limited to three.

Figure 12A:
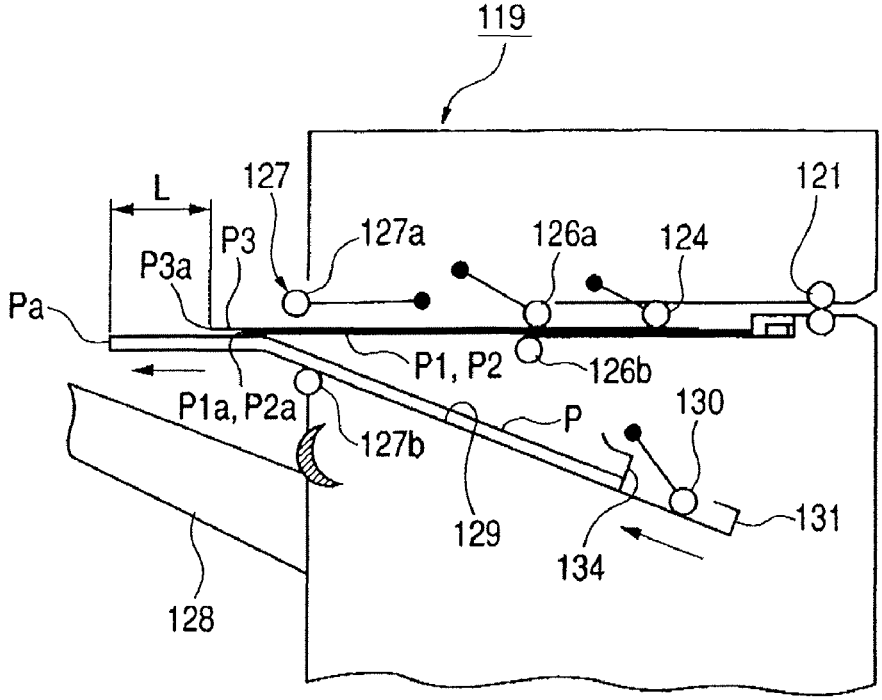
FIG. 12A is a diagram illustrating an operation of the sheet processing apparatus, which follows the operation of FIG. 11B, in a case where a sheet is to be buffered during sheet processing, and in a state where a sheet bundle is started to be delivered from the processing tray to a stack tray.

Further, by that time, the stapling processing with respect to the sheet bundle stacked on the processing tray 129 is completed, the trailing edge assist 134 is moved along the processing tray 129 to press the trailing edge of the sheet bundle upward as illustrated in FIG. 12A. The sheet bundle subjected to stapling processing is called stapled sheet bundle. As a result, a downstream edge Pa of the stapled sheet bundle P protrudes to the downstream side by a length L as compared with a downstream edge P3*a* of the third sheet P3.

Figure 12B:
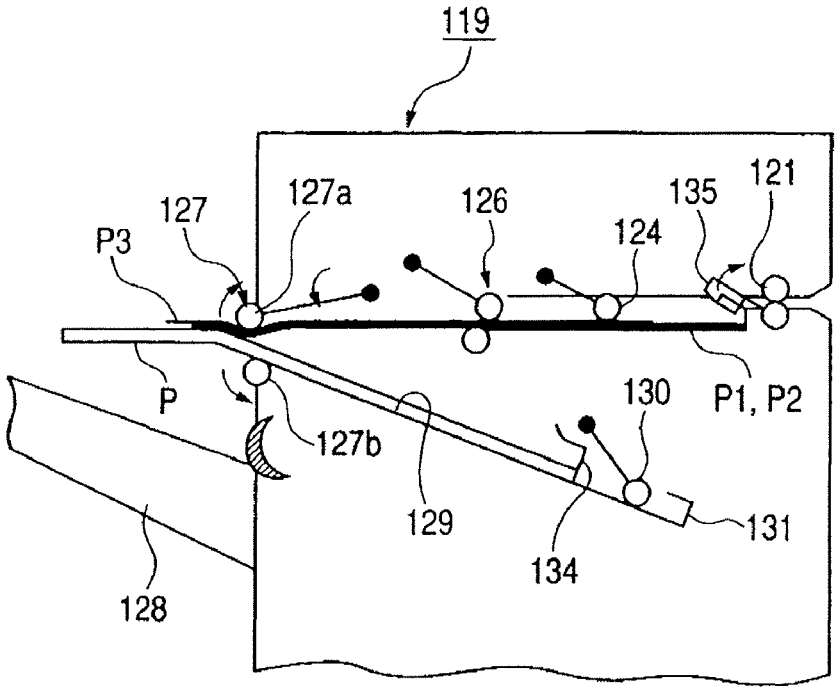
FIG. 12B is a diagram illustrating an operation of the sheet processing apparatus, in a case where a sheet is to be buffered during sheet processing, and in a state where the sheet bundle and a buffer sheet are conveyed in a discharge direction.

Then, as shown in FIG. 12B, the upper roller 127*a* also descends, and nips the three buffer sheets P1, P2, and P3 and the stapled sheet bundle P with the lower roller 127*b*. With the nipping of the sheets, the trailing edge 135 is separated from the second sheet P2, and the first sheet P1 and the second sheet P2 are released.

Figure 13A:
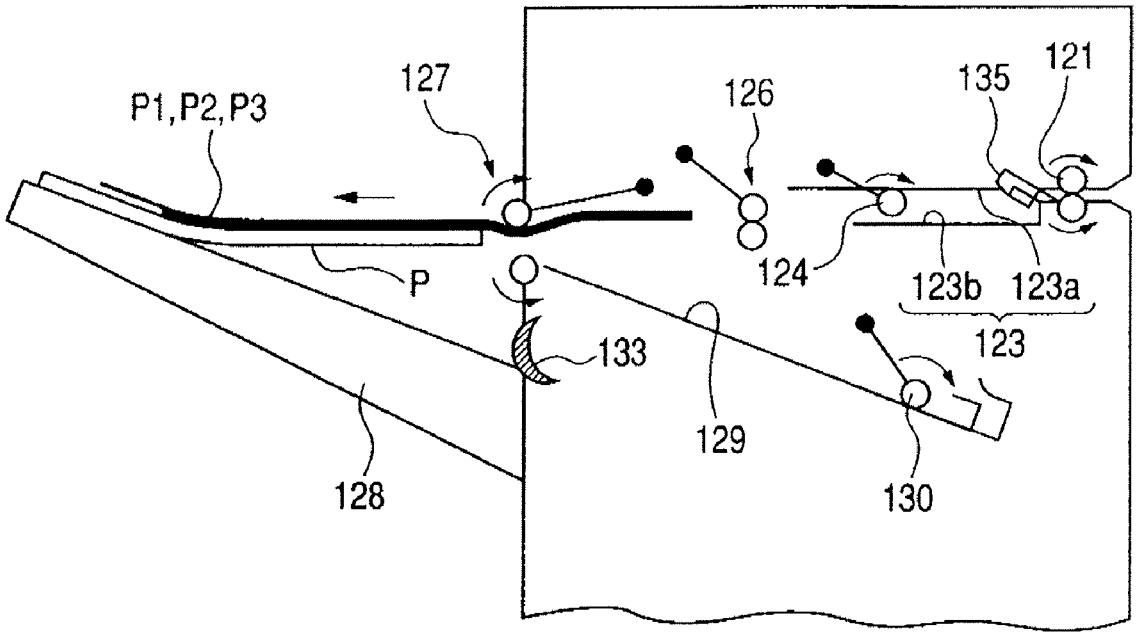
FIG. 13A is a diagram illustrating an operation of the sheet processing apparatus, which follows the operation of FIG. 12B, in a case where a sheet is to be buffered during sheet processing, and in a state where the sheet bundle is delivered from the processing tray to the stack tray.
Figure 13B:
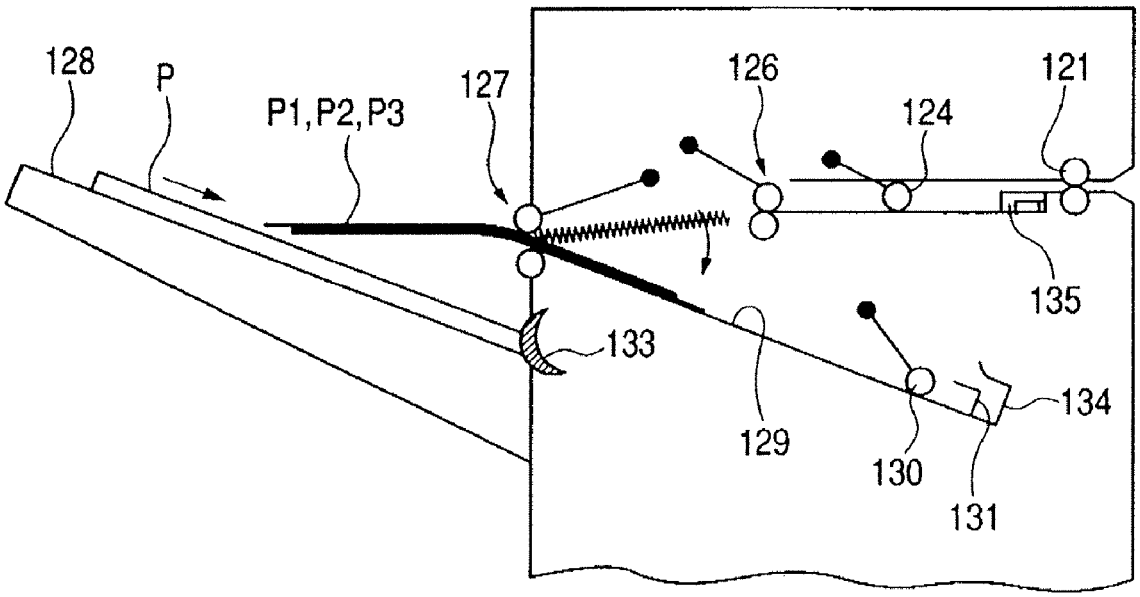
FIG. 13B is a diagram illustrating an operation of the sheet processing apparatus, in a case where a sheet is to be buffered during sheet processing, and in a state where the buffer sheet is fed to the processing tray.

After that, the three buffer sheets P1, P2, and P3, and the stapled sheet bundle P are nipped by the rocking roller pair 127 and conveyed (FIG. 12B). Then, as shown in FIGS. 13A and 13B, when the stapled bundle P is discharged onto the stack tray 128, the trailing edges of the first buffer sheet P1 and the second buffer sheet P2 come out of the first sheet discharge roller pair 126. Then, the upstream side portion of the third buffer sheet is received by the processing tray 129.

Figure 14A:
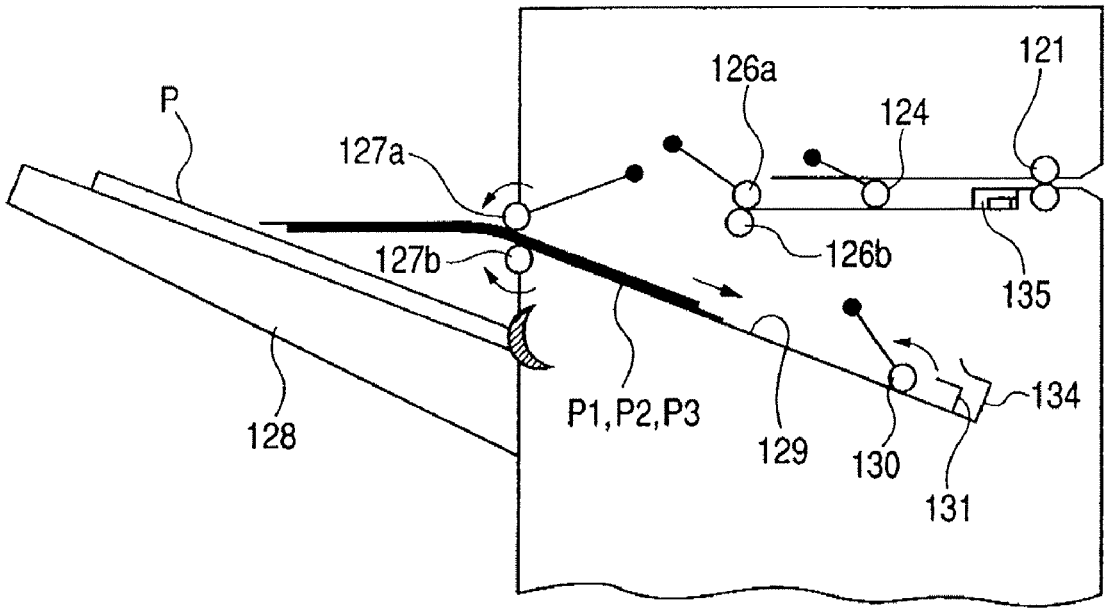
FIG. 14A is a diagram illustrating an operation of the sheet processing apparatus, which follows the operation of FIG. 13B, in a case where a sheet is to be buffered during sheet processing, and in a state where the buffer sheet is fed to the processing tray.
Figure 14B:
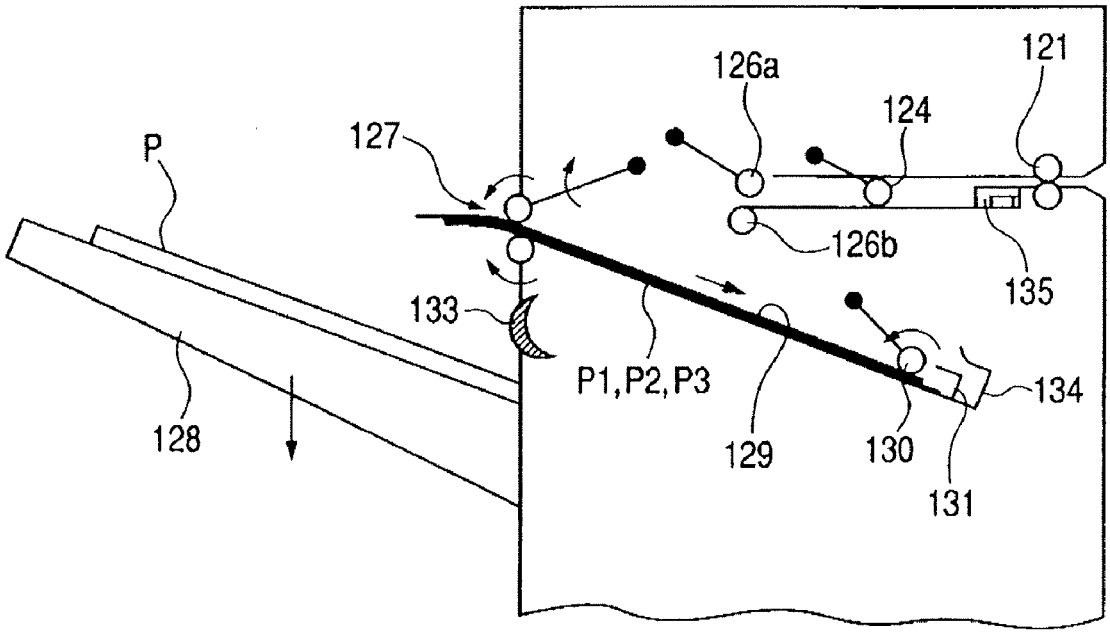
FIG. 14B is a diagram illustrating an operation of the sheet processing apparatus, in a case where a sheet is to be buffered during sheet processing, and in a state where the buffer sheet is further fed to the processing tray.

As shown in FIGS. 14A and 14B, the three buffer sheets are slid downward on the processing tray 129 by the rocking roller pair 127 and the return roller 130, and is received by the stopper 131. During the processing, the stack tray 128 temporarily descends to lower the upper surface of the stapled sheet bundle than the sheet surface detecting lever 133, and then ascends and the ascending is stopped when the sheet surface detecting lever 133 is operated to detect the upper surface of the sheet bundle. As a result, the upper surface of the stapled sheet bundle stacked on the stack tray 128 can be held at a predetermined height. After that, the number of successively supplied sheets are sequentially stacked on the processing tray 128 without being stored on the lower conveyance guide 123*b*. When the number of supplied sheets reaches the predetermined number, the sheets are stapled. During the stapling processing, the first three sheets of the subsequent sheet bundle are stored on the lower conveyance guide 123*b*.

Figure 15:
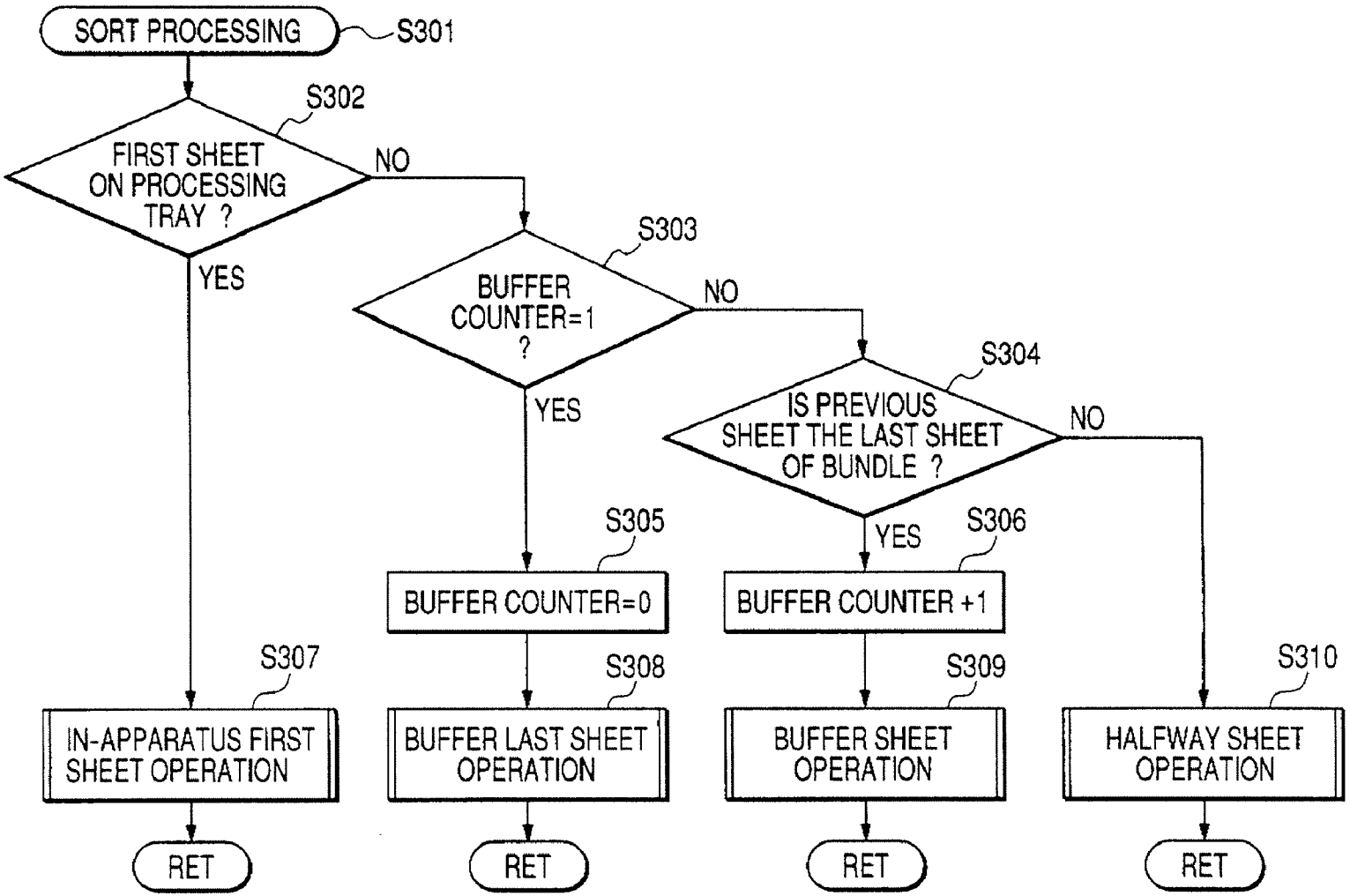
FIG. 15 is a flowchart illustrating an operation of the sheet processing apparatus of FIG. 3 when a sheet bundle is delivered.

Next, an operation of the sheet processing apparatus 119 will be described with reference to a flowchart. FIG. 15 is a flowchart of sort processing.

In sort processing (S301), the sheet processing apparatus 119 determines whether or not a sheet stacked in the processing tray 129 is the first sheet (S302), whether or not a buffer counter is 1 (S303), and whether or not a previous sheet is the last sheet of the sheet bundle (S304) Then, based on the determination, the sheet processing apparatus 119 performs one of an in-apparatus first sheet operation (S307), a buffer last sheet operation (S308), a buffer sheet operation (S309), a halfway sheet operation (S310).

The in-apparatus first sheet operation (S307) of FIG. 15 is an operation performed since the first sheet is stacked on the processing tray 129 until the sheet processing is started.

The buffer last sheet operation (S308) of FIG. 15 is an operation performed until the buffer sheet is stacked on the processing tray 129.

The buffer sheet operation (S309) of FIG, 15 is an operation of storing (buffering) a buffer sheet in the guide 123.

Figure 16:
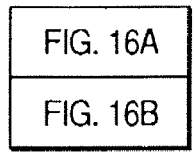
FIG. 16 which is composed of FIGS. 16A and 16B are flowcharts of a halfway sheet operation of FIG. 15.
Figure 16A:
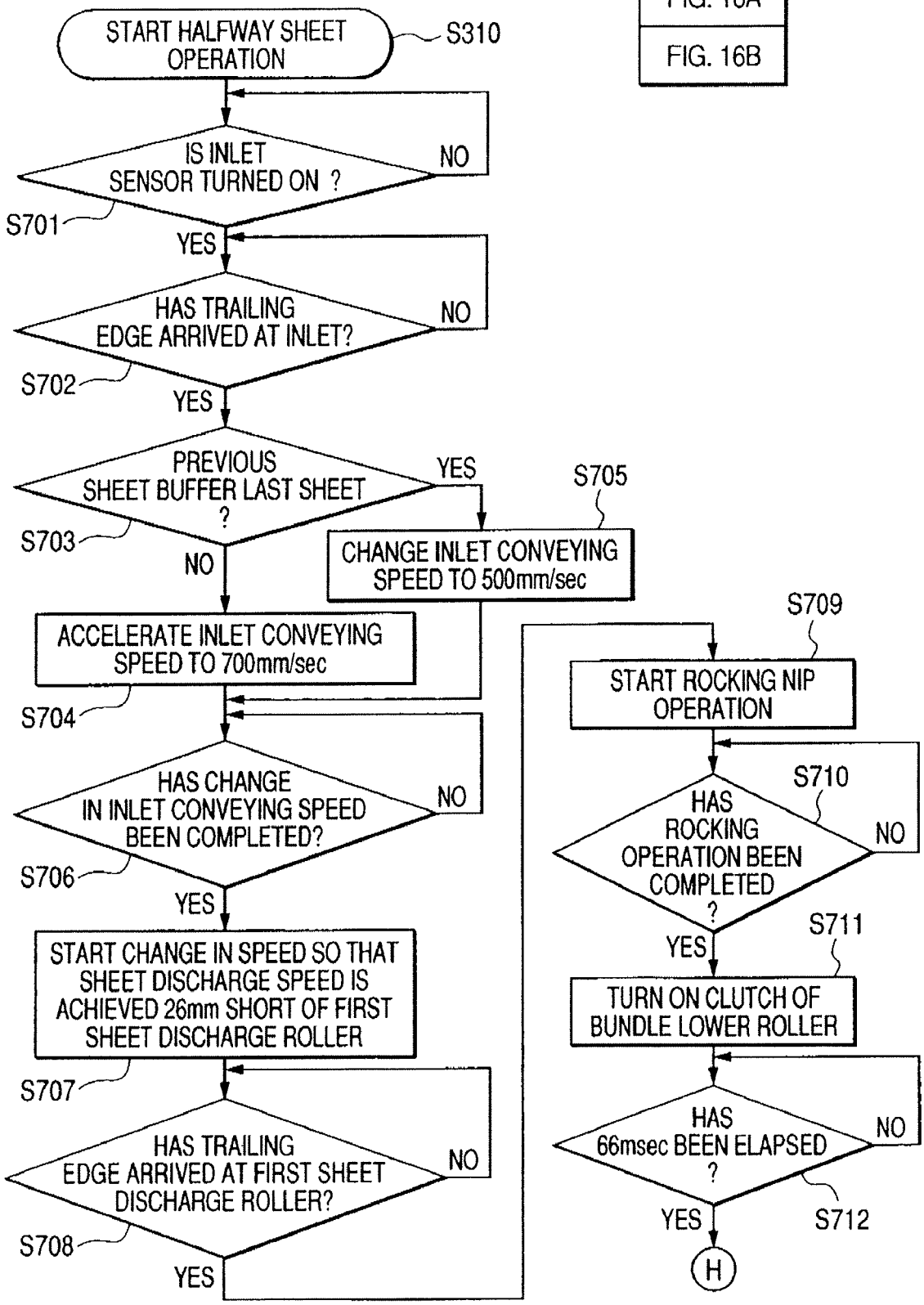
Figure 16B:
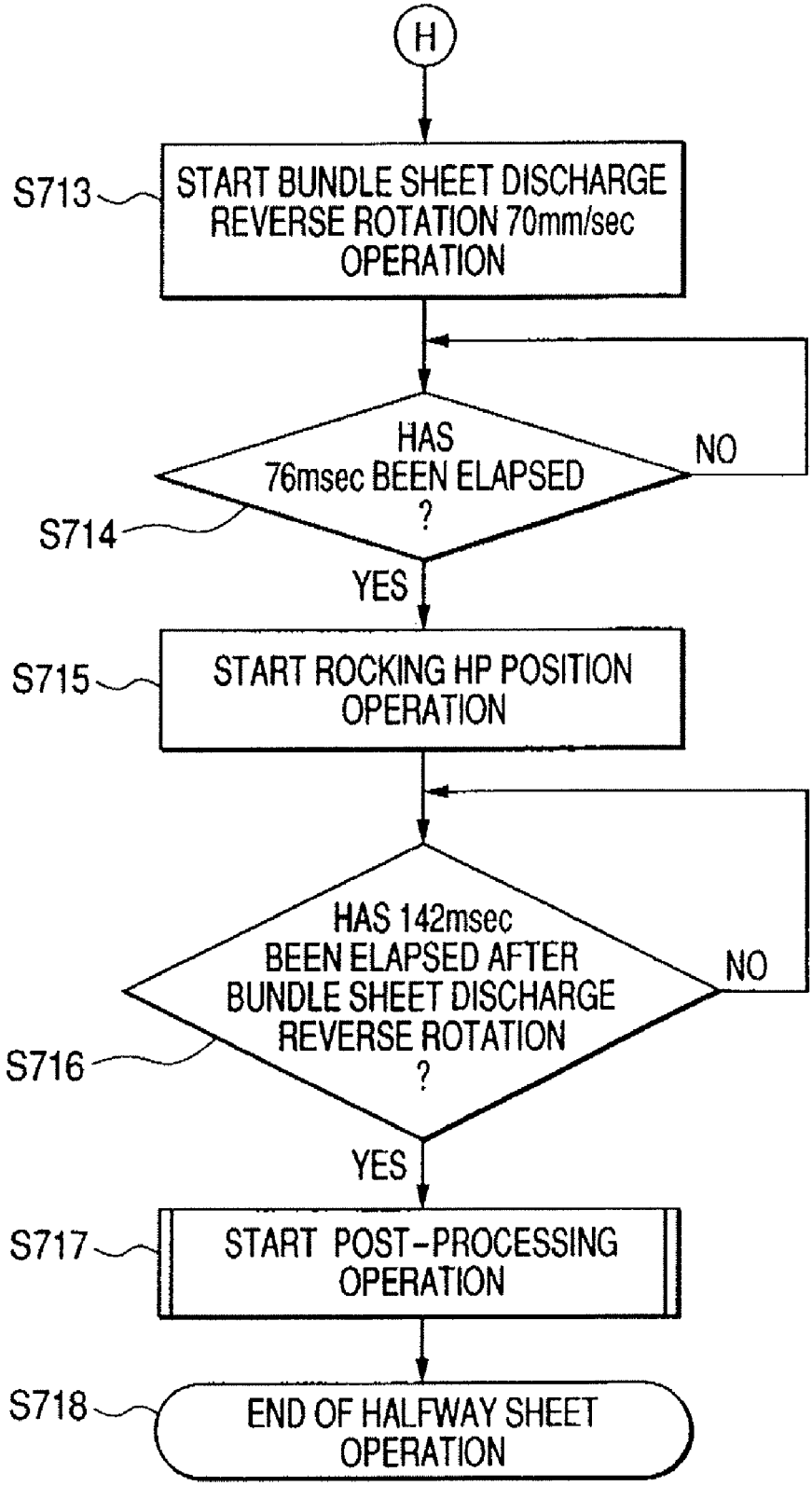

The halfway sheet operation (S310) of FIG. 15 is an operation performed until the second sheet and the subsequent sheets, or sheets subsequent to the last buffer sheet are stacked on the processing tray 129 as shown in Steps S701 and S718 of FIGS. 16A and 16B.

Start of a post-processing operation of Step S717 of FIG. 16B is an operation of performing post-processing after the sheets delivered from the apparatus main body 101 of the copying machine 100 are stacked on the processing tray 129. The post-processing is processing of aligning widths of the sheets by the alignment plates 144*a* and 144*b* and stapling a sheet bundle by the stapler unit 132.

(Description of Sheet Processing Apparatus in a Case Where a Conveyance Speed of a Sheet Fed from the Apparatus Main Body of the Copying Machine is High)

During the above-mentioned operations, the following problem arises in the sheet processing apparatus 119, depending on a distance between sheets fed from the apparatus main body 101 of the copying machine 100 or on a sheet conveyance speed.

That is, as shown in FIG. 12B, the rocking roller pair 127 is disposed in a buffer region of the buffer sheet so that the rocking roller pair 127 nips the sheet bundle P stacked on the processing tray 129 and the buffer sheet P1 to P3 at the same time and rotates to convey the sheets. Accordingly, while the three buffer sheets are slidingly conveyed on the processing tray 29 by the rocking roller pair 27 and the return roller 30 in FIG. 25, the leading edge of the subsequent sheet may be bought into abutment against the rocking roller pair 27. Such a sheet becomes a jammed sheet in many cases.

Figure 17A:
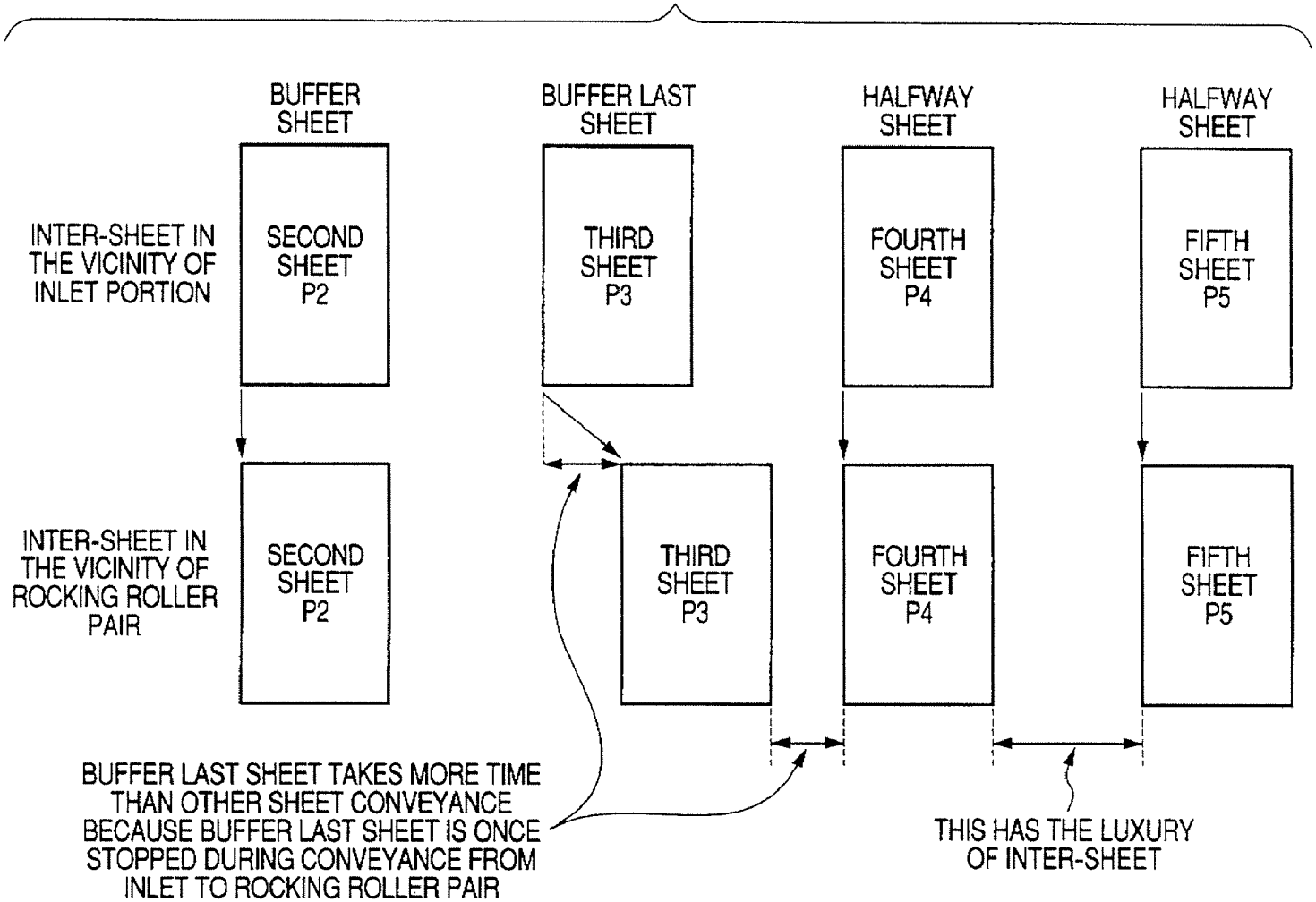
FIGS. 17A and 17B are diagrams illustrating that the subsequent sheet does not interfere with a rocking roller pair.

As shown in FIG. 17A, at an inlet of the sheet processing apparatus 119, the sheet conveying distance is constant irrespective of a preceding sheet bundle or a subsequent sheet bundle. However, with regard to the sheet conveying distance in the vicinity of the rocking roller pair 127, a distance between the second sheet P2 and the third sheet P3 is large. This is because conveyance of the last buffer sheet P3 is to be temporarily stopped.

The sheet conveying speed of the apparatus main body 101 of the copying machine 100 is 700 mm/sec. The receiving roller pair 137 and the inlet roller pair 121 that have received the sheet from the apparatus main body 101 of the copying machine 100 convey the sheet at the sheet conveying speed of 700 mm/sec by a drive force of the common conveyance motor M1 and the inlet conveyance motor M2 (S704 of FIG. 16A). However, the sheet conveying speed for a sheet P4 subsequent to the last buffer sheet P3 decreases to 500 mm/sec (S705).

The deceleration of the sheet conveying speed is performed such that the finisher controlling portion 211 controls the common conveyance motor M1 and the inlet conveyance motor M2 to be decelerated and rotated when the upper roller sensor S2 shown in FIG. 4 detects descending of the upper roller 127*a* and an inlet path sensor S1 detects the sheet. When the common conveyance motor M1 and the inlet conveyance motor M2 are controlled to be decelerated and rotated, the sheet conveying speeds of the receiving roller pair 137 and the inlet roller pair 121 are decelerated.

Figure 17B:
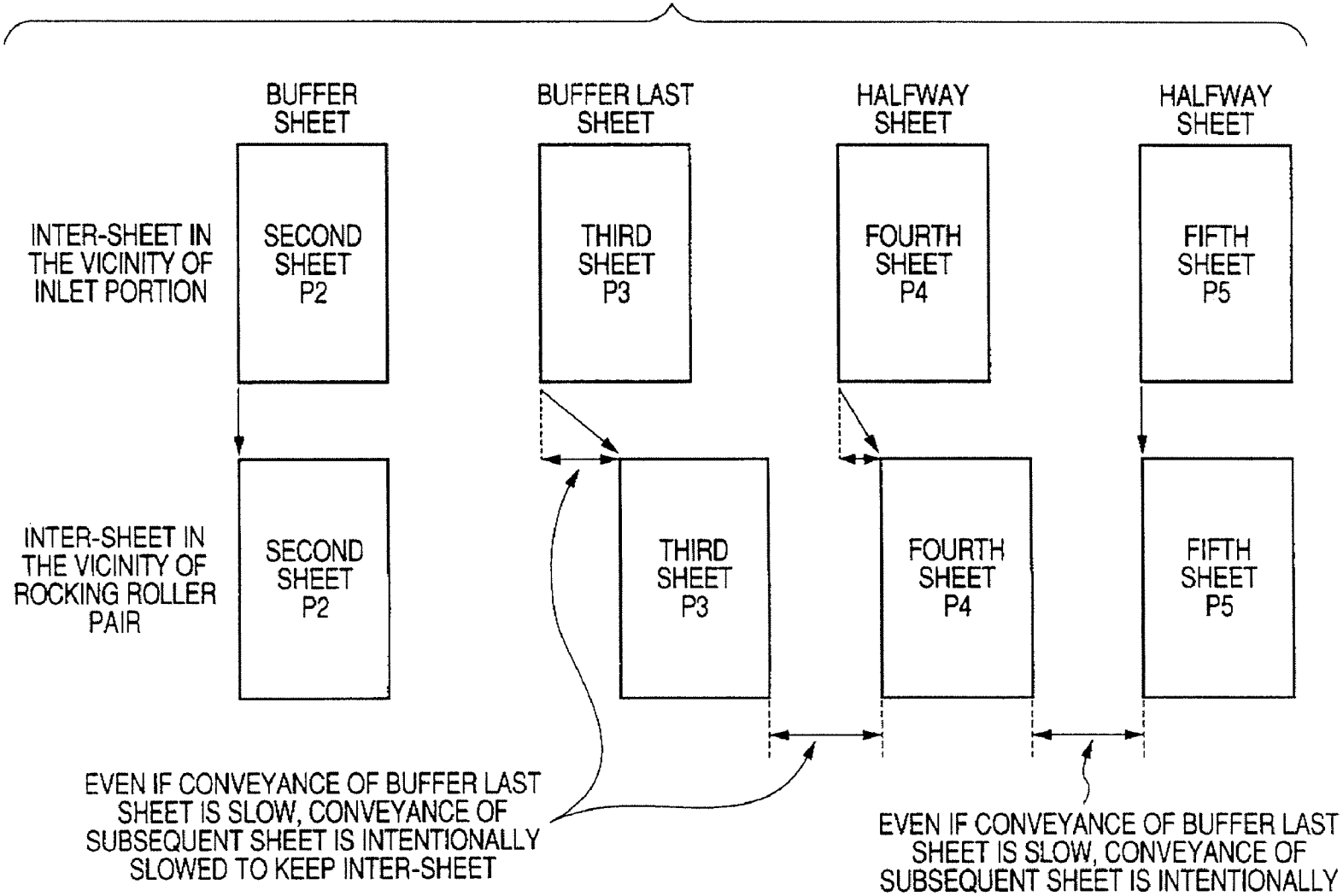

As shown in FIG. 17A, if the sheet is continuously conveyed at the sheet conveying speed of 700 mm/sec, while the last buffer sheet P3 is temporarily stopped, the subsequent sheet P4 comes closer to the last buffer sheet P3, thereby the distance between the sheets becomes small. However, the sheet conveying speed of the subsequent sheet P4 decreases to 500 mm/sec, as shown in FIG. 17B, the distance between the last buffer sheet P3 and the subsequent sheet P4 becomes large, unlike the case of FIG. 17A. As a result, unlike a case of FIG. 25, the leading edge of the subsequent sheet P4 is prevented from interfering with the rocking roller pair 127 before the rocking roller pair 127 is opened.

Figure 18:
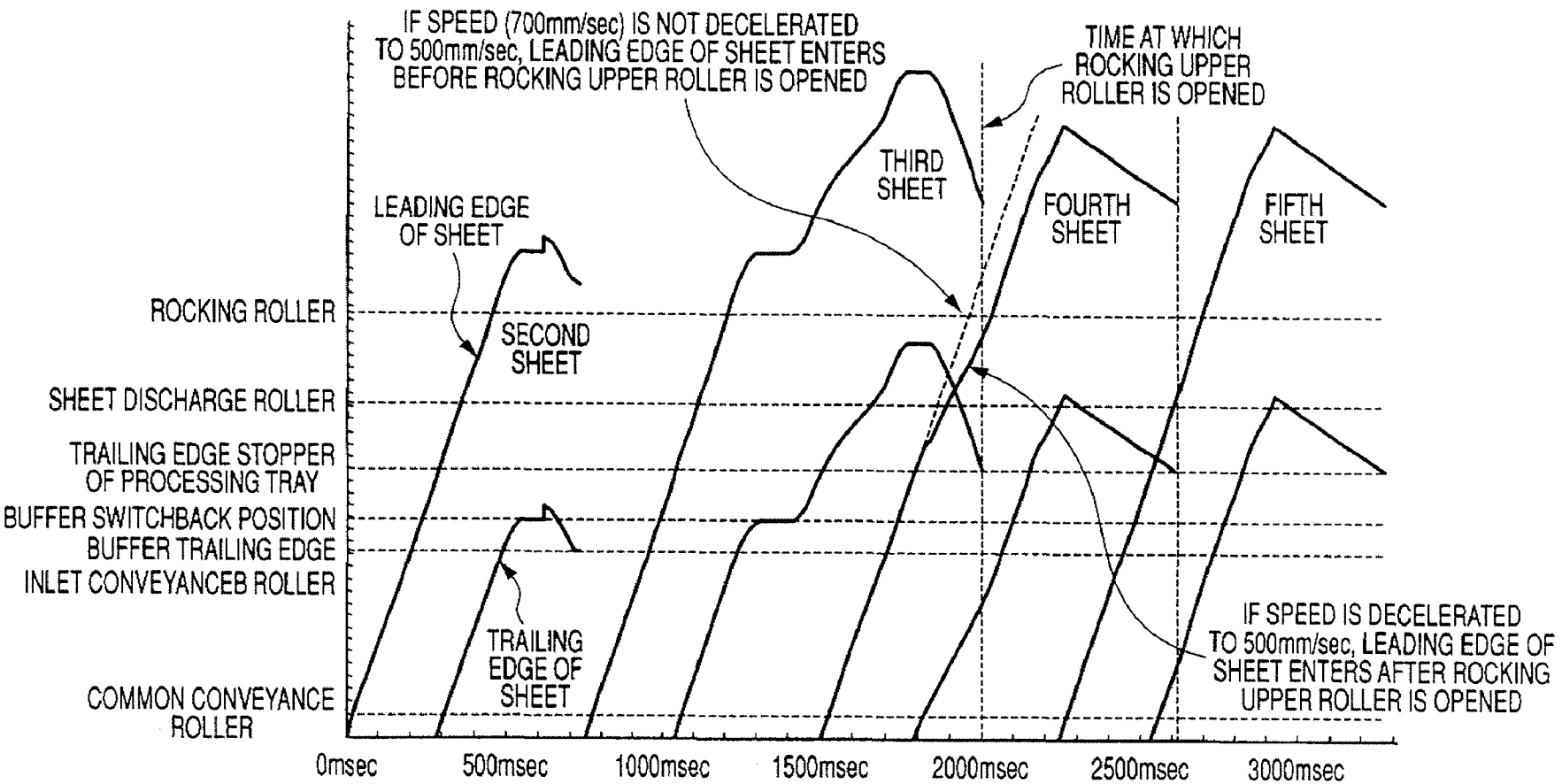
FIG. 18 is a timing chart illustrating where a leading edge and a trailing edge of the sheet are positioned with an elapse of time.

This fact is obvious from a timing chart of FIG. 18 which represents where the leading edge and the trailing edge of the sheet is positioned with an elapse of time. An axis of ordinate of FIG. 18 represents a distance from the inlet of the sheet processing apparatus, and an axis of abscissa of FIG. 18 represents time.

The vertical line represents a timing at which the upper roller 127*a* is opened when the third sheet is stacked on the processing tray 129. In a case where the subsequent fourth sheet is continuously conveyed at the sheet conveying speed of 700 mm/sec, the leading edge of the fourth sheet intersects the traverse line of the rocking roller pair 127 before the vertical line.

On the other hand, when the fourth sheet is conveyed at the decelerated sheet of 500 mm/sec, the traverse line of the rocking roller pair 127 intersects the curve representing the leading edge of the fourth sheet behind the vertical line, thereby avoiding collision between the rocking roller pair 127 and the leading edge of the fourth sheet.

Figure 25:
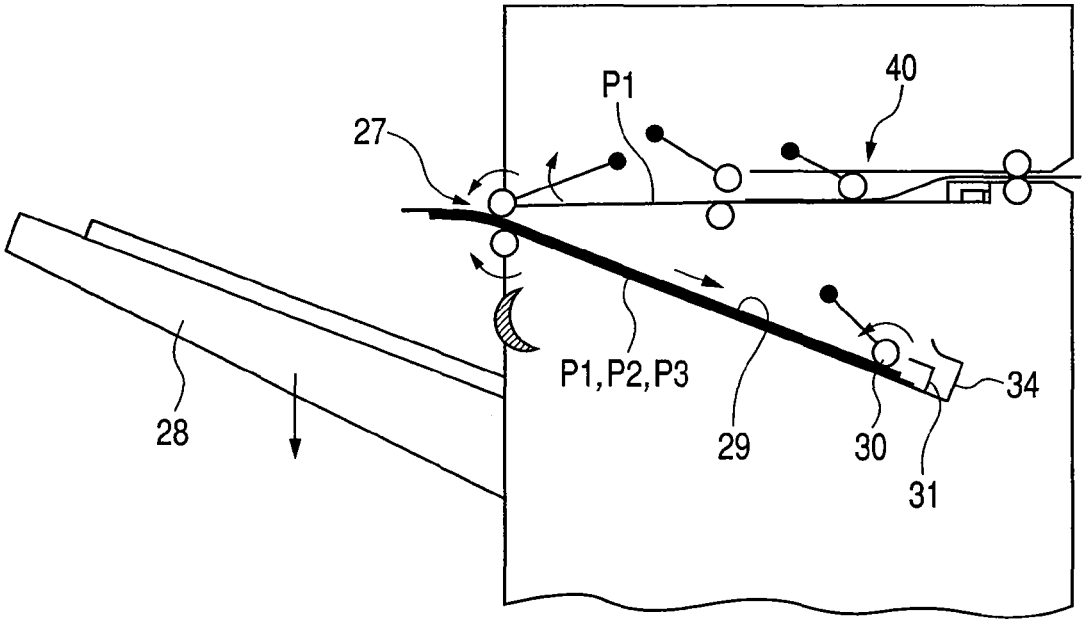
FIG. 25 PRIOR ART
FIG. 25 is a diagram illustrating a problem caused in the conventional sheet processing apparatus.

Thus, by decelerating the sheet conveying speed, the phenomenon shown in FIG. 25 can be avoided, but, the same effect can be obtained by temporarily stopping the sheet P4 subsequent to the last buffer sheet P3 or increasing/reducing the stopping time.

In the above-mentioned embodiment, the case of stapling the sheet bundle is described, but, even when the sheet is punched, conveyance of sheets is stopped during the punching operation. Also in this case, by lengthening the stopping time of the sheet subsequent to the last buffer sheet than the stopping time for punching in the last buffer sheet, distances between sheets as shown in FIGS. 17A and 17B can be made, thereby making it possible to avoid collision between the rocking roller pair 27 and the leading edge of the sheet as shown in FIG. 25.

The above-mentioned deceleration of the sheet is performed such that the finisher controlling portion 211 controls the common conveyance motor M1 and the inlet conveyance motor M2 to be decelerated and rotated to decelerate and rotate the receiving roller pair 137 and the inlet roller pair 121, but the deceleration of the sheet may be performed by controlling rotation of the roller of the apparatus main body 101.

In other words, when the upper roller sensor S2 shown in FIG. 4 detects descending of the upper roller 127*a* and the inlet path sensor S1 detects the sheet, the finisher controlling portion 211 sends a decelerating signal to the CPU circuit portion 200. The CPU circuit portion 200 having received the decelerating signal delays the start of rotation of the registration roller pair 150. Thus, the distance between sheets may be changed.

In the above description, a case where the number of sheets of the sheet bundle subjected to stapling processing is equal to or more than the number of buffer sheets of the buffering unit is described, but the number of sheets of the sheet bundle may be less than the number of buffer sheets. In this case, when the preceding sheet bundle is being stapled by the stapler unit 132, the sheet of the subsequent sheet bundle is fed to the buffering unit, and the n the first several sheets of the subsequent sheet bundle are also fed thereto. In such a case, when the subsequent sheet bundle is to be stapled, sheets of further subsequent sheet bundle are stapled.

To deal with the problem, in the sheet processing apparatus 119 according to this embodiment, the finisher controlling portion 211 regulates the sheet conveying speed of the inlet roller pair 121 depending on whether or not the number of job sheets to be processed by the stapler unit 132 is less than the number of buffer sheets.

In other words, in the sheet processing apparatus 119, the finisher controlling portion 211 controls the inlet conveyance motor M2 when the number of job sheets to be processed by the stapler unit 132 is less than the predetermined number of buffer sheets, to thereby set the sheet conveying speed of the inlet roller pair 121 to be slower than the sheet conveying speed of the apparatus main body 101. Further, when the number of job sheets to be processed by the stapler unit 132 is more than the predetermined number of buffer sheets, the sheet conveying speed of the inlet roller pair 121 is set to be equal to the sheet conveying speed of the apparatus main body 101.

As a result, in the sheet processing apparatus 119 according to this embodiment, the sheets equal to the number of job sheets are buffered to the buffer sheet unit 140, but the sheets of the subsequent sheet bundle are not buffered thereto. Thus, the stapler unit 132 can perform the sheet processing for each one job.

When the sheet conveying speed of the inlet roller pair 121 is set to be slower than the sheet conveying speed of the apparatus main body 101, there is a risk that sheets may be jammed, but actually, the distance between sheets becomes small and jamming does not occur.

Further, instead of regulating the sheet conveying speed of the inlet roller pair 121, the rotation start timing of the registration roller pair 150 of the apparatus main body may be controlled by the finisher controlling portion 211 and the CPU circuit portion 200. The controlling of the rotation start timing will be described below.

A process of calculating a sheet distance (top-to-top; distance between leading edges of sheets) time (sheet waiting time) will be described. The sheet distance time may be a distance between trailing edges of sheets.

In the finisher controlling portion 211, a user inputs the number of sheets per one bundle (the number of job sheets) to the operation portion 210 (see FIG. 2).

A pre-registration turned-on signal is sent from the CPU circuit portion 200 of the apparatus body 101 of the copying machine to the finisher controlling portion 211 as a sheet conveying prediction. Processing of calculating the sheet distance time is executed at the time of receiving the pre-registration turned-on signal issued at the time of starting sheet feeding of the apparatus main body 101 of the copying machine. The pre-registration turned-on signal is added with information such as a sheet size, a post-processing mode, a first sheet, and a last sheet. The finisher controlling portion 211 calculates a minimum necessary sheet distance (top-to-top) time with respect to the sheet which is immediately before the sheet processing apparatus 119 receives according to those parameters, and returns the sheet distance time to the CPU circuit portion 200 of the apparatus main body 101.

Specifically, the finisher controlling portion 211 first checks whether or not the sheet is a bundle first sheet based on the added information (S401). In the case where the sheet is not the first sheet, that is, the sheet is a halfway sheet or a last sheet, the finisher controlling portion 211 adds a sheet waiting time bundle accumulated value variable of the RAM 223 (see FIG. 6) to a sheet waiting time variable value (S402).

In a case where the sheet is the bundle first sheet, the finisher controlling portion 211 assigns 0 to the sheet waiting time bundle accumulated value variable (S403). The sheet waiting time bundle accumulated value is used in the subsequent step.

The sheet waiting time bundle accumulated value is a value obtained by accumulating sheet distance times of the plurality of sheets.

Then, the finisher controlling portion 211 checks whether or not the sheet is the sheet bundle first sheet again (S404). In a case where the sheet is not the first sheet, that is, the sheet is the halfway sheet or the last sheet, the finisher controlling portion 211 increments a bundle sheet number counter 225 (see FIG. 6) (S405). In the case where the sheet is the bundle first sheet, the finisher controlling portion 211 substitutes the value of the bundle sheet number counter for the previous bundle sheet number variable (S406), and further reset the bundle sheet number counter to 1 (S407). In this case, the sheet number of the sheet in the bundle is checked, and the number of sheets of the previous bundle is stored.

Then, the finisher controlling portion 211 checks whether or not the value of the previous bundle sheet number variable is smaller than a buffer maximum sheet number (S408). When the value of the previous bundle sheet number variable is smaller than the buffer maximum sheet number, the finisher controlling portion 211 substitutes the buffer maximum sheet number for a buffer expected sheet number variable of the RAM 223 (S409) When the value of the previous bundle sheet number variable is not smaller than the buffer maximum sheet number, that is, when the previous bundle sheet number is the buffer maximum sheet number or more, the finisher controlling portion 211 substitutes the previous bundle sheet number variable for the buffer expected sheet number variable (S410). In this case, the number of sheets to be buffered is obtained.

The buffer maximum sheet number is the maximum number (predetermined number) of sheets that can be contained in the buffer part, and the number of this case is set to, for example, 3.

Next, the finisher controlling portion 211 performs processing of determining a sheet waiting time based on the value of the variable obtained in the manner as described above.

First, the finisher controlling portion 211 checks whether the sheet is a bundle last sheet (S411). When the sheet is the bundle last sheet, the finisher controlling portion 211 checks whether a post-processing time is equal to or larger than the sheet waiting time bundle accumulated value previously obtained (S412). When the sheet waiting time bundle accumulated value is smaller than the post-processing time, the finisher controlling portion 211 substitutes the value obtained by subtracting the sheet waiting time bundle accumulated value from the post-processing time, for the sheet waiting time variable of the RAM 223 (see FIG. 6) (S413). In a case where the sheet waiting time bundle accumulated value already exceeds the post-processing time, the finisher controlling portion 211 substitutes a minimum time for the sheet waiting time variable (S414). The minimum time is a sheet a minimum reception sheet distance (top-to-top) time expected by a sheet post-processing apparatus, and the minimum reception sheet distance time of this case is, for example, 60/51 (≈1.18) [sec].

Further, when the sheet is not the bundle last sheet in Step S411, the finisher controlling portion 211 checks whether the bundle sheet number counter is smaller than the previous bundle sheet number (S415). When the bundle sheet number counter is smaller than the previous bundle sheet number, the finisher controlling portion 211 substitutes a result obtained by dividing the post-processing time by the value of the buffer expected number, for the sheet waiting time variable (S416) When the bundle sheet number counter is larger than the previous bundle sheet number, the finisher controlling portion 211 substitutes the value of the minimum time for the sheet waiting time variable (S414) Finally, the sheet waiting time obtained at this time is returned to the CPU circuit portion 200 of the apparatus main body 101 (S417), and a series of processing is completed.

Through the processing of this case, in a case where a request for the bundle last sheet is sent from the apparatus main body, if a necessary post-processing time is not secured by the sheets obtained until that time, a waiting time for the sheets that have not reached is obtained (S413) to prevent the first sheet of the subsequent bundle from entering before the post-processing for the previous bundle is finished. In a case where the sheet is not the last sheet, the necessary post-processing time is equally divided by the expected buffer sheet number (S416) to cause the sheet to wait. As a result, the apparatus main body 101 having high throughput can secure the post-processing time by the waiting time of a total of the expected sheet numbers. While, the apparatus main body 101 having low throughput can exert productivity thereof at maximum by suppressing the waiting time for each sheet as much as possible.

In the above-mentioned processing, a sheet conveying distance within the same sheet bundle is obtained based on the stapling processing time of the stapler unit 132 and the number of sheets of the previous sheet bundle.

In the processing of another embodiment to be described below, a conveying distance between sheet bundles is obtained based on the stapling processing time of the stapler unit 132 and the maximum number (predetermined number) of buffer sheets to be buffered to the buffering unit 140.

Figure 20:
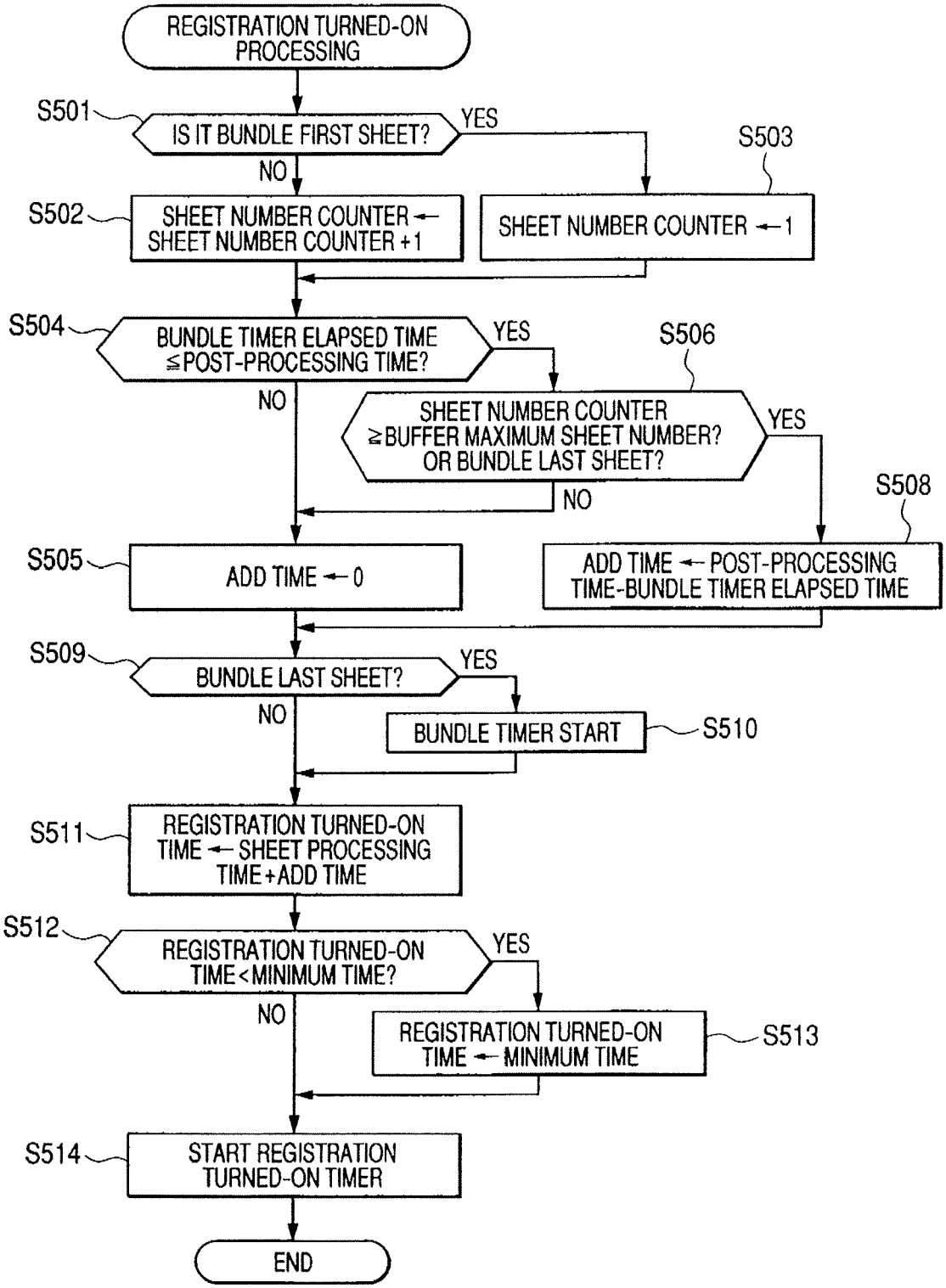
FIG. 20 is a flowchart illustrating an operation different from that of FIGS. 19A and 19B.
Figure 21:
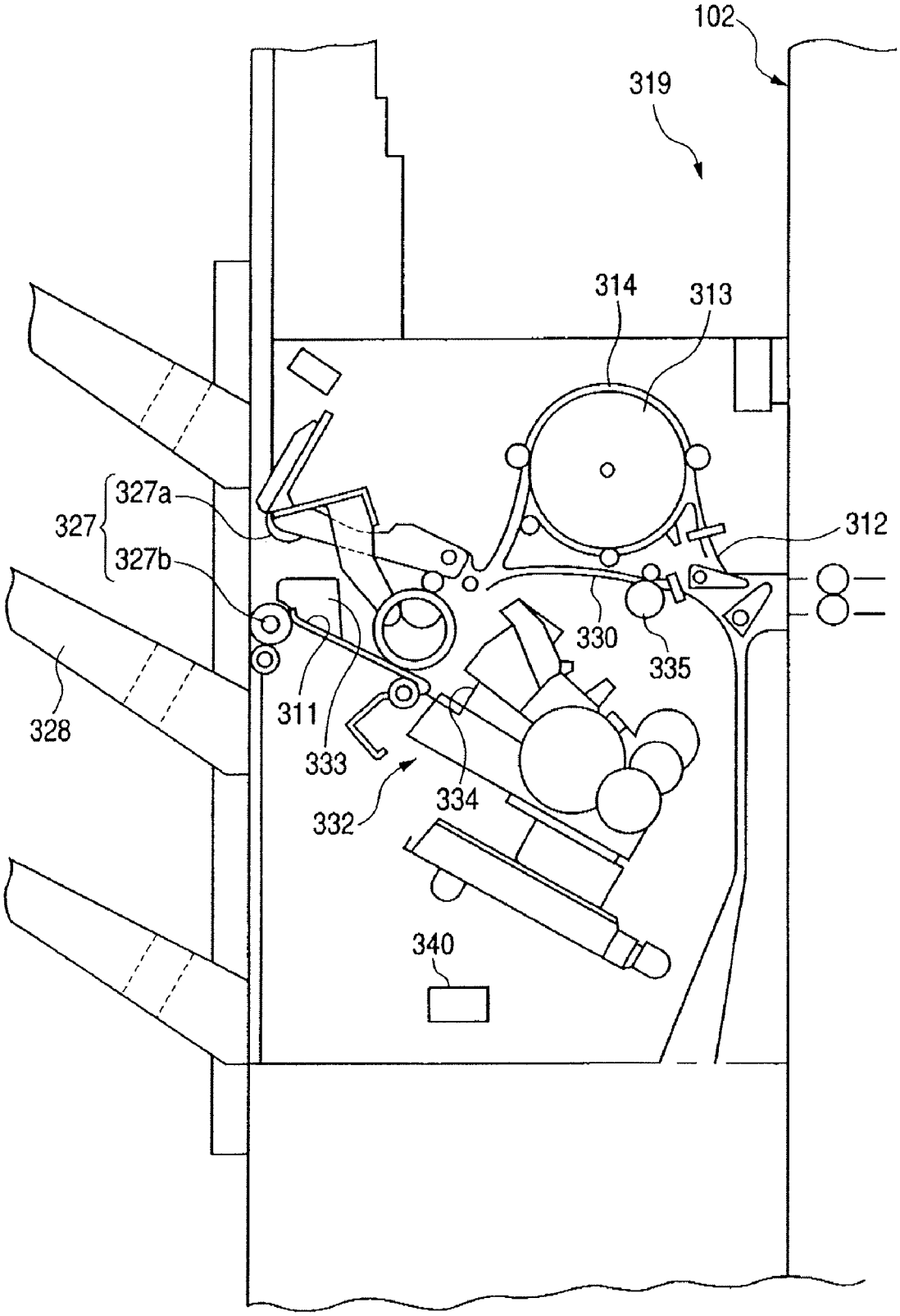
FIG. 21 is a cross-sectional view taken along a sheet conveyance direction of a sheet processing apparatus according to another embodiment of the present invention.
Figure 22A:
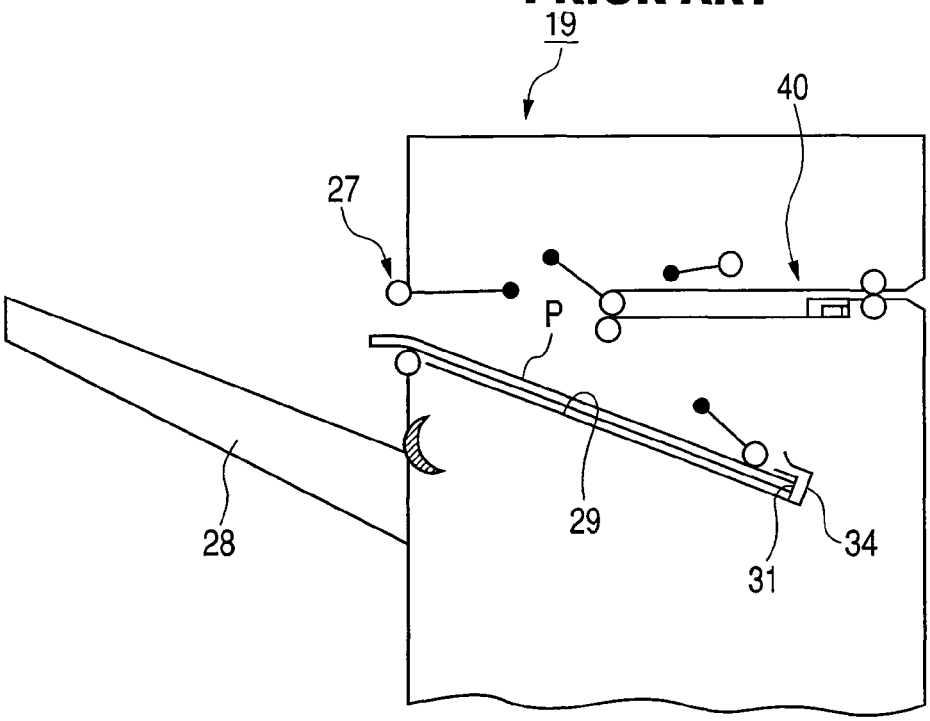
FIG. 22A PRIOR ART
FIGS. 22A and 22B are diagrams illustrating an operation of a conventional sheet processing apparatus.
Figure 22B:
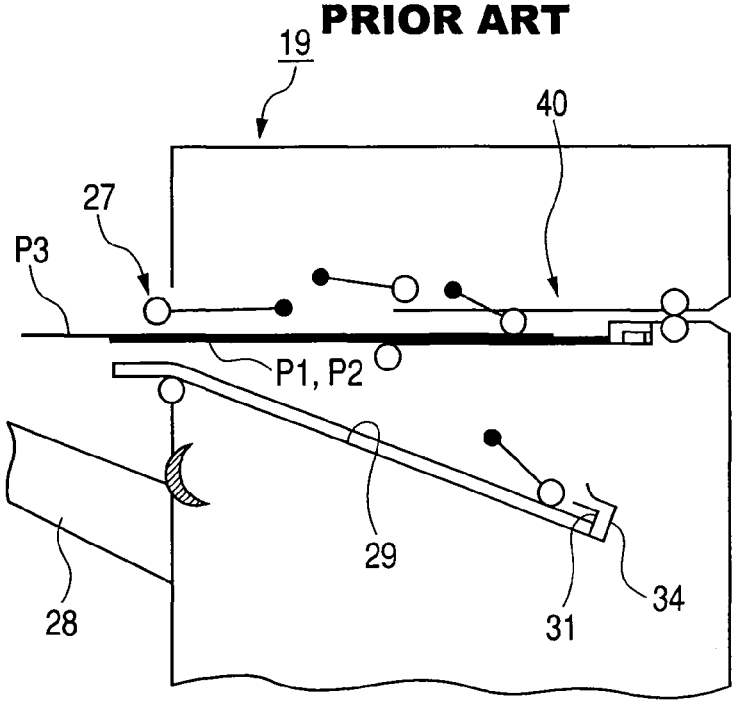
FIG. 22B PRIOR ART
Figure 23A:
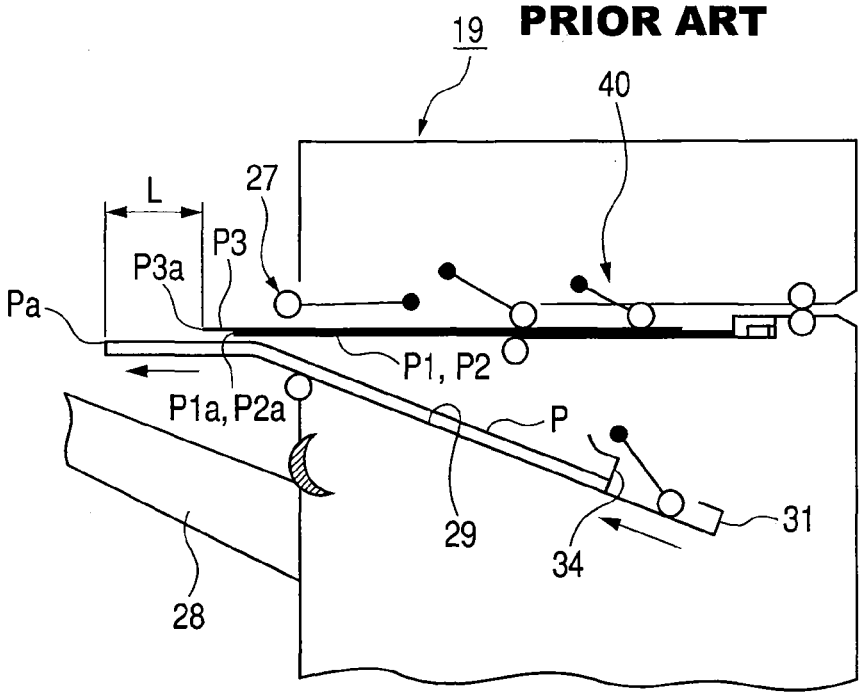
FIG. 23A PRIOR ART
FIGS. 23A and 23B are diagrams illustrating an operation of the conventional sheet processing apparatus which follows the operations of FIGS. 17A and 17B.
Figure 23B:
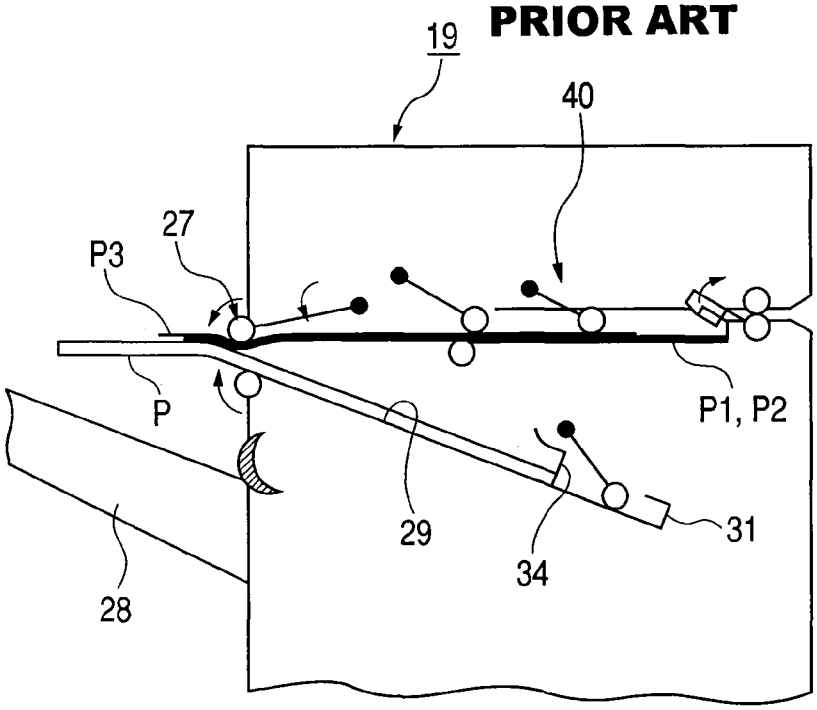
FIG. 23B PRIOR ART
Figure 24A:
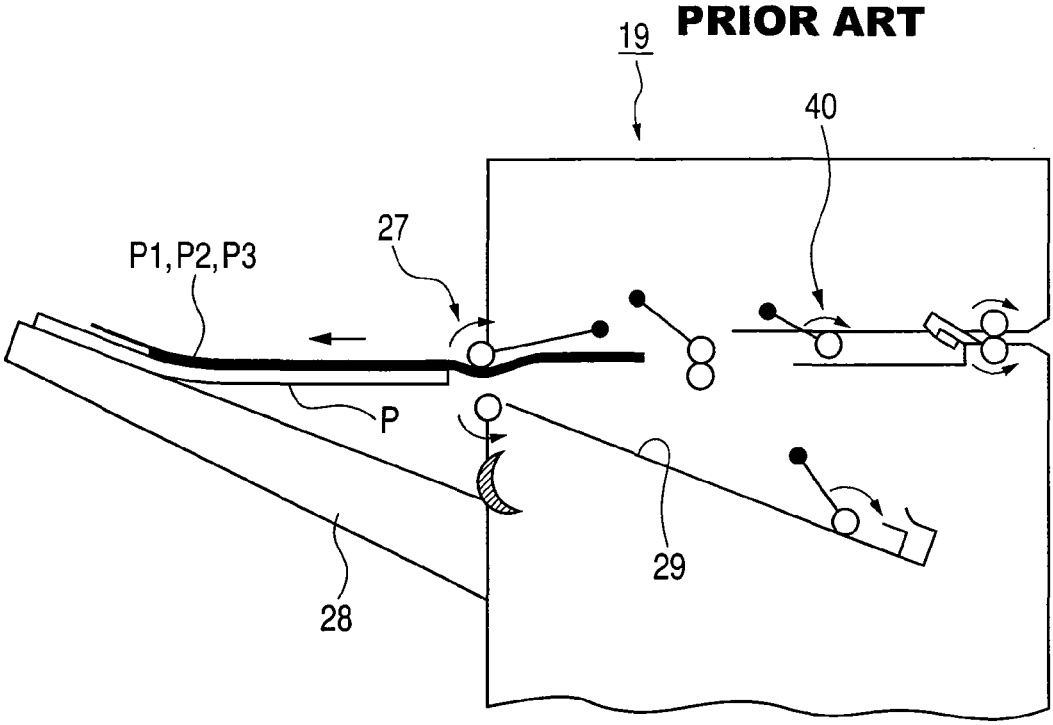
FIG. 24A PRIOR ART
FIGS. 24A and 24B are diagrams illustrating an operation of the conventional sheet processing apparatus which follows the operation of FIG. 18.
Figure 24B:
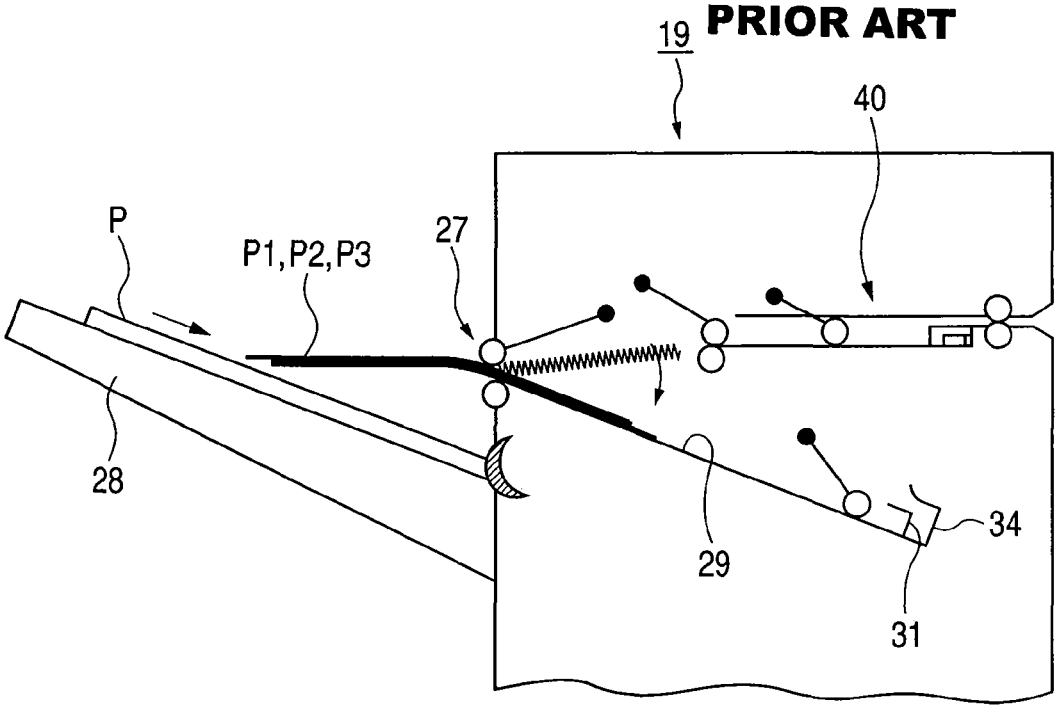
FIG. 24B PRIOR ART

Processing shown in FIG. 20 is similar to the embodiment shown in FIG. 21 in terms of mechanism, but is different in control.

FIG. 20 illustrates a registration turned-on processing with respect to the apparatus main body 101 of a copying machine of this embodiment.

The registration turned-on processing is executed when a sheet is fed to the photosensitive drum 114 in the apparatus main body 101. Before execution of the registration turned-on processing, the CPU circuit portion 200 of the apparatus main body 101 receives information such as the post-processing time, the buffer maximum sheet number, and the sheet waiting time from the sheet processing apparatus 119.

As examples of the values of this case, the stapling processing (post-processing) is 2.5 [sec], the buffer maximum sheet number is 3, and the sheet waiting time is 60/51 [sec].

This processing is executed when the drive for the registration roller pair 150 (see FIG. 1) is started. First, the finisher controlling portion 211 checks whether the sheet is the first sheet (S501). When the sheet is not the first sheet, the finisher controlling portion 211 increments the sheet number counter 225 (S502). When the sheet is the first sheet, the finisher controlling portion 211 resets the sheet number counter to 1 (S503).

Next, the finisher controlling portion 211 checks whether a bundle timer elapsed time is smaller than the post-processing time (S504). When the bundle timer elapsed time is smaller than the post-processing time, the finisher controlling portion 211 checks whether the sheet number counter is larger than the buffer maximum sheet number or whether the sheet is the last sheet (S506). When the sheet number counter is larger than the buffer maximum sheet number and the sheet is the last sheet, the finisher controlling portion 211 substitutes the value obtained by subtracting the bundle timer elapsed time from the post-processing time, for an add time of the RAM 223 (see FIG. 6) (S508). When the result shows NO prong in Step S504 or NO prong in Step S506, the finisher controlling portion 211 substitutes 0 for an add time variable (S505) In this case, when the post-processing time is elapsed by the bundle timer measurement time, excessive waiting is not performed, and when the post-processing time is not attained by the bundle timer measurement time and the buffer maximum sheet number is attained, or only when the sheet is the last sheet, the finisher controlling portion 211 substitutes an unattained time for the add time.

Then, the finisher controlling portion 211 checks whether the sheet is the last sheet (S509), and starts a bundle timer only when the sheet is the last sheet (S510).

Then, the finisher controlling portion 211 substitutes the value obtained by adding the add time previously obtained to the sheet waiting time received from the sheet processing apparatus 119, for a registration turned-on time variable (S511).

Then, the finisher controlling portion 211 checks whether the value of the registration turned-on time variable is smaller than the minimum time (S512), and substitutes the minimum time for the registration turned-on time (S513) only when the value of the registration turned-on time is smaller than the minimum time.

The minimum time is a sheet distance (top-to-top (distance between leading edges)) time capable of conveying at a minimum distance and forming an image in the copying machine. For example, when the maximum throughput is 51 [ppm], the sheet distance time is 60/51 (≈1.18) [sec] and when the maximum throughput is 45 [ppm], the sheet distance time is 60/45 (≈1.33) [sec]. 51 [ppm] is a sheet conveyance speed for conveying 51 sheets per minute.

Finally, a registration turned-on timer is started at the registration turned-on time previously obtained (S514).

When the time of the timer is up, this processing is executed again and is repeated until the job is finished.

Through this processing, when the elapsed time at that time within the sheet bundle is less than the post-processing time and the number of sheets of the sheet bundle is larger than the buffer maximum sheet number, no more sheets can be buffered. As a result, the necessary sheet distance can be secured at the sheer number of (buffer maximum sheet number+1). Further, when the last sheet is supplied, the necessary sheet distance can be secured by the first sheet corresponding to the subsequent sheet.

As described above, even when the elapsed time for each bundle is shorter than the post-processing time, it is possible to secure the minimum necessary sheet distance by the first sheet of the subsequent sheet. Thus, even in a case of an estimated small number of sheets used in many cases, the copying machine and the sheet processing apparatus 119 can exert the maximum performance thereof.

In the above description, the photosensitive drum 114 is an example of an image forming portion. The inlet roller pair 121, the receiving roller pair 137, and the registration roller pair 150 are examples of a conveying unit. The processing tray 129 is an example of a stacking unit. The stapler unit 132 is an example of a processing unit. The rocking roller pair 127 is an example of a rotary member pair or a transferring unit. The finisher controlling portion 211 is an example of a controlling unit.

Figures 19, 19A:
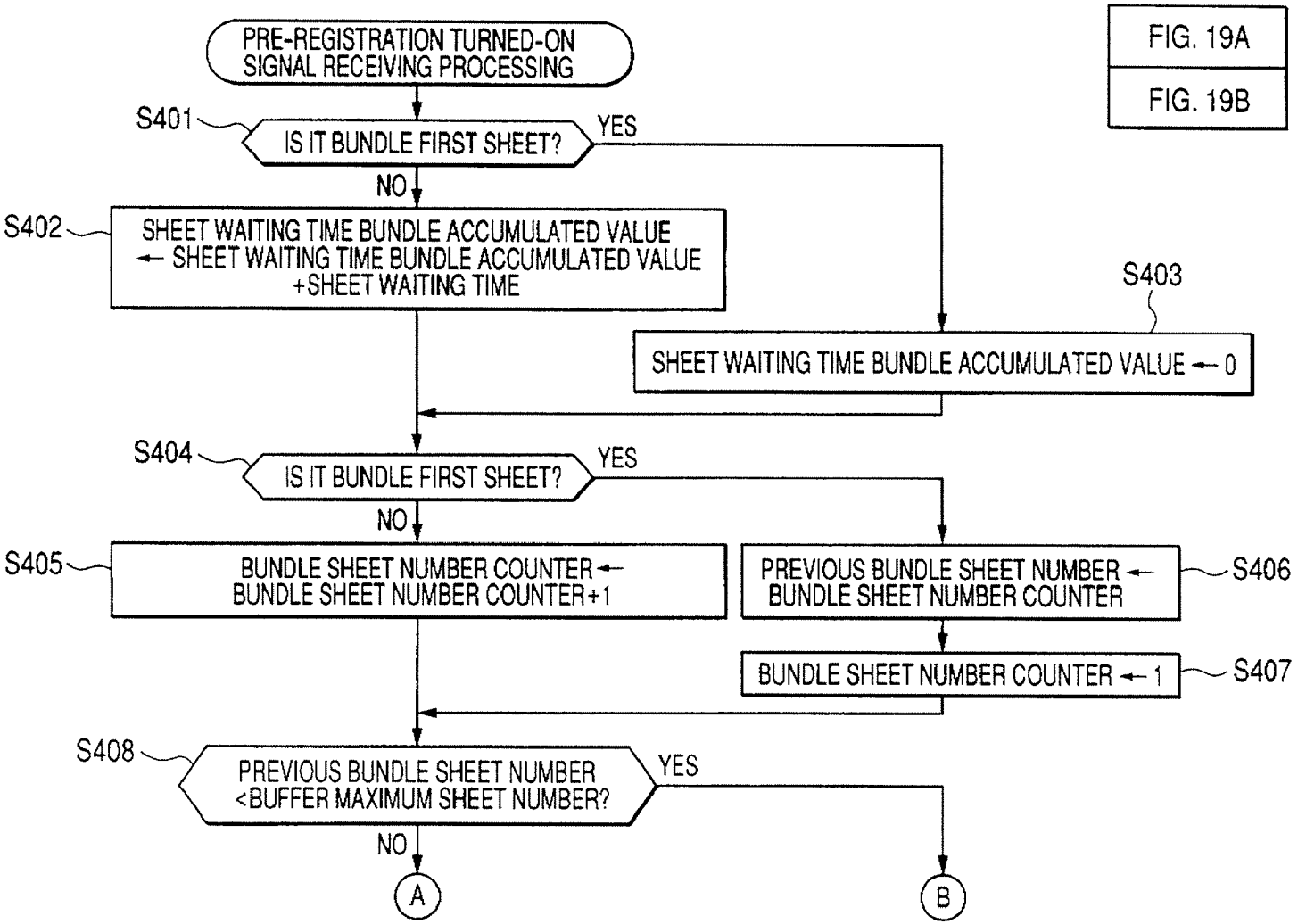
FIG. 19 which is composed of FIGS. 19A and 19B are flowcharts illustrating an operation when the numbers of sheets, which are less than those a buffering unit can buffer, are buffered.
Figure 19B:
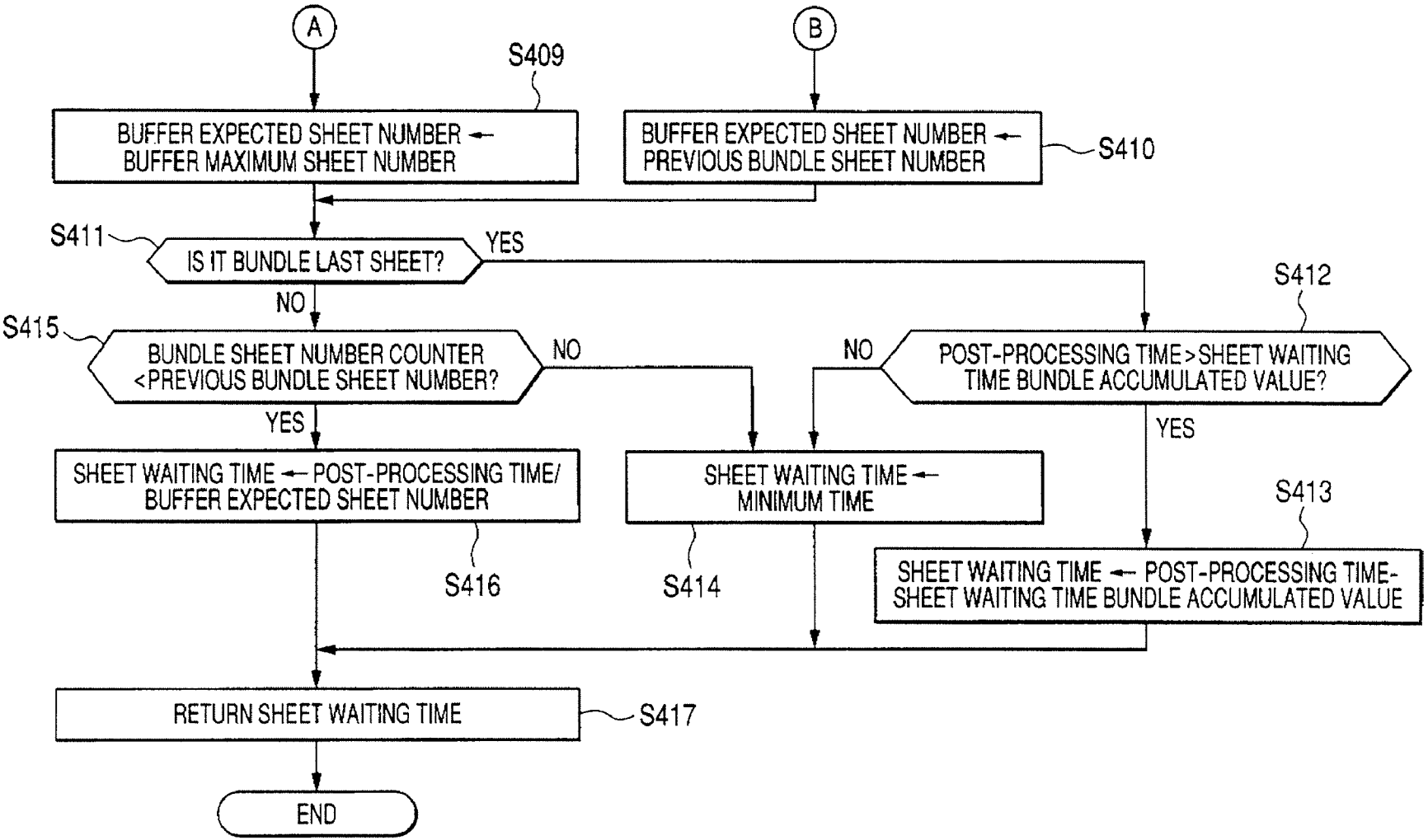

Further, the sheet processing apparatus described above is one including the buffering unit 140 for storing (buffering) a plurality of sheets superimposed one on another in a straight state at the operation of the stapler unit 132. Also in another sheet processing apparatus including a buffering unit including a buffer roller 313 and a buffer roller path 314 as shown in FIG. 21 in place of the buffering unit 140, it is possible to apply the processing shown in FIGS. 19 and 20. Accordingly, the present invention is not limited to the sheet processing apparatus including the buffering unit 140 for storing (buffering) a plurality of sheets superimposed one on another in a straight state.

In this case, a conveying roller 335 is an example of the conveying unit. An intermediate processing tray 311 is an example of the stacking unit. A stapler 332 is an example of the processing unit. A rocking roller pair 327 is an example of the rotary member pair or the transferring unit. A finisher controlling portion 340 is an example of the controlling unit.

In the above description, a sheet position is detected by a sensor, but may be determined based on sheet holding information (memory information) managed by the CPU 221.

Further, the copying machine 100 includes the sheet processing apparatus 119 capable of preventing misalignment of the unstapled sheet bundle. Accordingly, a user is not required to align the sheet bundle again, thereby preventing the user from making troubles.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2006-100933 filed Mar. 31, 2006, which is hereby incorporated by reference herein in its entirety.

What is claimed is:

1. A sheet processing apparatus, comprising:

a conveying unit, which conveys a sheet;

a stacking unit on which the sheet conveyed by the conveying unit is stacked;

a processing unit, which processes the sheet stacked on the stacking unit;

a buffering unit, which allows the sheet conveyed to the stacking unit by the conveying unit to pass, and buffers a predetermined number of sheets to be passed during an operation of the processing unit;

a transferring unit arranged in a region for the predetermined number of buffered sheets buffered to the buffering unit, for receiving the predetermined number of buffered sheets and closing to nip the predetermined number of buffered sheets to transfer the predetermined number of buffered sheets from the buffering unit to the stacking unit after the predetermined number of buffered sheets are buffered; and a controlling unit, which controls a sheet conveying speed of the conveying unit, wherein after the controlling unit detects a last sheet of the predetermined number of buffered sheets, the controlling unit controls the conveying unit to reduce the sheet conveying speed of the conveying unit to reduce a sheet conveying speed of a sheet subsequent to the last sheet of the predetermined number of buffered sheets so that a leading edge of the subsequent sheet is prevented from interfering with the transferring unit before the transferring unit is opened, and the controlling unit restores the sheet conveying speed of the conveying unit after the subsequent sheet is conveyed.

2. A sheet processing apparatus according to claim 1, wherein the transferring unit includes a pair of rotary members, and the pair of rotary members are spaced apart from each other when receiving the buffer sheets, and nip the predetermined number of buffered sheets when conveying the buffer sheets to rotationally convey the buffer sheets.

3. A sheet processing apparatus according to claim 1, wherein the controlling unit starts to reduce the sheet conveying speed of the subsequent sheet when a trailing edge of the subsequent sheet reaches the conveying unit.

4. A sheet processing apparatus according to claim 2, wherein the pair of rotary members are brought into contact with the predetermined number of buffered sheets and sheets processed by the processing unit to discharge the processed sheets.

5. An image forming apparatus, comprising:

an image forming portion, which forms an image on a sheet; and a sheet processing apparatus, which processes the sheet on which the image is formed by the image forming portion, wherein the sheet processing apparatus is a sheet processing apparatus according to claim 1.

6. An image forming apparatus, comprising:

an image forming portion, which forms an image on a sheet; and a sheet processing apparatus, which processes the sheet on which the image is formed by the image forming portion, wherein the sheet processing apparatus is a sheet processing apparatus according to claim 2.

7. An image forming apparatus, comprising:

a conveying unit, which conveys a sheet;

an image forming portion, which forms an image on a sheet;

a stacking unit on which the sheet conveyed by the conveying unit is stacked;

a processing unit, which processes the sheet stacked on the stacking unit;

a buffering unit, which allows the sheet conveyed to the stacking unit by the conveying unit to pass, and buffers a predetermined number of sheets to be passed during an operation of the processing unit;

a transferring unit arranged in a region for the predetermined number of buffered sheets buffered to the buffering unit, for receiving the predetermined number of buffered sheets and closing to nip the predetermined number of buffered sheets to transfer the predetermined number of buffered sheets from the buffering unit to the stacking unit after the predetermined number of buffered sheets are buffered; and a controlling unit, which controls a sheet conveying speed of the conveying unit, wherein after the controlling unit detects a last sheet of the predetermined number of buffered sheets, the controlling unit controls the conveying unit to reduce the sheet conveying speed of the conveying unit to reduce a sheet conveying speed of a sheet subsequent to the last sheet of the predetermined number of buffered sheets so that a leading edge of the subsequent sheet is prevented from interfering with the transferring unit before the transferring unit is opened, and the controlling unit restores the sheet conveying speed of the conveying unit after the subsequent sheet is conveyed.

8. An image forming apparatus according to claim 7, wherein the transferring unit comprises a pair of rotary members, and the pair of rotary members are spaced apart from each other when receiving the predetermined number of buffered sheets, and nip the predetermined number of buffered sheets when transferring the buffered sheets to rotationally convey the predetermined number of buffered sheets.

9. An image forming apparatus according to claim 7, wherein the conveying unit comprises a roller pair arranged on an upstream side of the image forming portion.

10. An image forming apparatus according to claim 7, wherein the controlling unit starts to reduce the sheet conveying speed of the subsequent sheet when a trailing edge of the subsequent sheet reaches the conveying unit.

11. An image forming apparatus according to claim 8, wherein the pair of rotary members are brought into contact with the predetermined number of buffered sheets and sheets processed by the processing unit to discharge the processed sheets.

* * * * *